US012428911B2

(12) United States Patent
King

(10) Patent No.: US 12,428,911 B2
(45) **Date of Patent: *Sep. 30, 2025**

(54) ADJUSTABLE DRILLING RIG

(71) Applicant: K & K INNOVATIONS LTD, Mt. Morris, PA (US)

(72) Inventor: Christopher Tyler King, Waynesburg, PA (US)

(73) Assignee: K&K INNOVATIONS LTD, Mt. Morris, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/679,699

(22) Filed: May 31, 2024

(65) Prior Publication Data

US 2024/0318503 A1 Sep. 26, 2024

Related U.S. Application Data

(63) Continuation of application No. 17/383,067, filed on Jul. 22, 2021, now Pat. No. 12,000,280.

(51) Int. Cl.
*E21B 7/02* (2006.01)

(52) U.S. Cl.
CPC ..... *E21B 7/026* (2013.01); *E21B 7/027* (2013.01)

(58) Field of Classification Search
CPC ..... E21B 7/026; E21B 7/027; E21B 7/024; E21B 15/04
USPC ..... 173/197, 81, 90, 140–141, 162.1, 213, 173/168–171; 227/1–2, 8–19, 51, 63–64, 227/77–82, 99, 107, 140, 156
See application file for complete search history.

(56) References Cited

U.S. PATENT DOCUMENTS

| | | | |
|---|---|---|---|
| 1,445,086 | A | 2/1923 | Joy |
| 2,162,553 | A | 6/1939 | Hirschberg |
| 2,210,628 | A | 8/1940 | Eugenio |
| 2,908,483 | A | 10/1959 | Stephenson |
| 3,256,943 | A | 6/1966 | Olov |
| 3,919,816 | A | 11/1975 | Ranft |
| 3,977,547 | A | 8/1976 | Holopainen |

(Continued)

FOREIGN PATENT DOCUMENTS

| | | | | |
|---|---|---|---|---|
| EP | 0392672 | A1 | 10/1990 | |
| EP | 2781683 | A1 | 9/2014 | |
| WO | WO-2022103981 | A1 * | 5/2022 | ..... B25H 1/0042 |

*Primary Examiner* — Robert F Long
(74) *Attorney, Agent, or Firm* — Metz Lewis Brodman Must O'Keefe

(57) ABSTRACT

An adjustable drilling rig is provided for drilling and installation of foundational micropile matrices in difficult to access locations. A support frame of separately adjustable legs define a perimeter of the rig and drilling area. A translational frame of arms and a crossbar is selectively mounted to the support frame for easy transport and assembly at remote work sites. The crossbar is selectively slidable along the arms in a Y-axis direction. A crossbar bushing is selectively slidable along the crossbar in an X-axis direction. A mast is slidably attached to and movable with the crossbar. Various adjusters are included and are independently and selectively activated to move the crossbar, and therefore mast and attached drill head, translationally along the X- and Y-axes, optionally Z-axis, and rotationally about the X- and Y-axes to achieve five degrees of freedom in five planes for drilling at any angle within the drilling area.

23 Claims, 21 Drawing Sheets

(56) References Cited

U.S. PATENT DOCUMENTS 4,250,973 A 2/1981 Hall
4,252,063 A 2/1981 Brooks, Jr.
4,285,154 A 8/1981 Grahl
4,296,509 A 10/1981 Simmons et al.
4,441,564 A 4/1984 Castillo
4,537,263 A * 8/1985 Bjor ..... E21B 7/022 173/195
4,645,084 A 2/1987 Deike
4,690,376 A 9/1987 Duncan
4,858,700 A 8/1989 Shafer
4,917,214 A * 4/1990 Mlaker ..... B66F 11/044 182/2.2
4,944,056 A 7/1990 Schroeder et al.
4,989,798 A * 2/1991 Nickell ..... B65H 54/553 242/486.7
5,006,022 A * 4/1991 Miller ..... B25H 1/0042 408/110
5,014,863 A 5/1991 Maanderen
5,213,169 A 5/1993 Heller
5,226,488 A 7/1993 Lessard et al.
5,375,664 A * 12/1994 McDowell ..... E02D 7/18 173/147
5,383,524 A * 1/1995 Rinnemaa ..... E21B 7/022 173/1
5,435,399 A 7/1995 Peterson et al.
D378,457 S 3/1997 Page
5,709,276 A 1/1998 Lee
5,954,143 A 9/1999 McCabe et al.
6,269,913 B1 8/2001 Kollmannsberger et al.
6,315,059 B1 11/2001 Geldean
6,460,652 B1 10/2002 Piipponen
6,715,563 B2 4/2004 Hubbard
6,890,288 B2 5/2005 Bingham
8,327,950 B2 12/2012 Pollock et al.
8,602,123 B2 12/2013 Edmonds et al.
9,086,241 B2 7/2015 Bystedt
9,291,793 B2 * 3/2016 Cooper ..... G02B 7/001
10,464,200 B1 * 11/2019 Walter ..... E21B 11/005
11,624,236 B2 4/2023 Smart
2003/0070708 A1 * 4/2003 Stuart ..... F24S 25/10 136/251
2003/0205395 A1 * 11/2003 Edwards ..... E21B 7/028 173/184
2005/0200087 A1 * 9/2005 Vasudeva ..... B25F 3/00 279/143
2008/0044236 A1 * 2/2008 Lloyd ..... E02D 7/16 173/39
2009/0121537 A1 5/2009 Orgard
2009/0314547 A1 * 12/2009 Stoetzer ..... E21B 7/023 175/57
2010/0012340 A1 1/2010 Kuosmanen
2011/0042142 A1 2/2011 Edmonds et al.
2011/0044766 A1 * 2/2011 Salisbury ..... E21B 15/003 405/232
2012/0031679 A1 2/2012 Pollock et al.
2012/0247836 A1 10/2012 Wilson et al.
2013/0056514 A1 * 3/2013 Maloney ..... B23P 19/001 227/95
2014/0037415 A1 2/2014 Zuritis
2016/0108598 A1 * 4/2016 Waxse ..... E02D 7/06 702/33
2016/0138299 A1 5/2016 Powers, III
2016/0221170 A1 8/2016 Moore
2018/0119492 A1 5/2018 Nelson
2018/0326507 A1 11/2018 Halvorsen et al.
2019/0154194 A1 * 5/2019 Leblanc ..... F16M 11/42
2019/0169009 A1 6/2019 Gales
2020/0149241 A1 * 5/2020 Flanigan ..... E02D 13/00
2022/0154534 A1 * 5/2022 Schmitz ..... E21B 25/00
2022/0341265 A1 * 10/2022 Callarotti ..... E21B 7/023
2022/0373229 A1 * 11/2022 McKinion ..... E04H 12/2253
2023/0022559 A1 * 1/2023 King ..... E21B 15/04
2023/0340747 A1 * 10/2023 Kraft ..... E02D 7/22

* cited by examiner

ADJUSTABLE DRILLING RIG

CLAIM OF PRIORITY

The present application is a Continuation of co-pending U.S. patent application Ser. No. 17/383,067, filed on Jul. 22, 2021, the contents of which are incorporated by reference herein in its entirety.

FIELD OF THE INVENTION

This invention relates to drill rigs, and more particularly, to drill rigs used for drilling micropile assemblies on uneven terrain.

BACKGROUND

In the geotechnical construction industry, supports and anchors are installed in support of various structures. An example of these supports are micropiles, which anchor the above ground structure to the corresponding bed rock. In particular applications, the location of these anchors may be in remote locations that are difficult to access.

In the oil and gas industry, it is often necessary to drill wells, such as natural gas wells, in remote locations that are difficult to access. These drill sites may frequently be inaccessible by road, having hilly or rocky terrain and uneven ground. The geographic topography of the desired drill site may therefore preclude to prevent the transportation of the necessary drilling equipment to the site by conventional means, such as by truck. Instead, the equipment for these remote drill locations must be alternatively transported to the site, such as by helicopter from a nearby location. The drilling equipment must therefore be sufficiently lightweight that an aircraft can transport it to the remote site. It should also preferably have the ability to level the equipment since the ground or terrain of the drill site is often rugged and not flat. Finally, it should have the ability to drill at an angle, since the ground in such areas is not flat and drill holes may need to be at an angle, such as micropile arrays.

There are some drill rigs that attempt to solve this problem. For instance, U.S. Pat. No. 8,602,123 discloses a drill assembly for use at a difficult to access work site, specifically for the preparation and installation of radial arrays of micropiles. Its various components are flown to the site and the drill assembly is assembled on site. A platform is first positioned on the ground and leveled. A centering ring is then lowered onto and secured to the platform. The centering ring can be adjusted laterally to position the opening therein over the desired target site for drilling. A rotating slide base is then mounted to the centering ring, both axially and radially. This slide base rotates a full 360°. The platform, centering ring, and slide base each define different planes which are parallel to one another. With the components assembled, the drill may be mounted thereto. The assembly has three degrees of freedom, permitting adjustments to the position of the drill: (1) translationally along the X-axis, (2) rotationally about the Y-axis, and (3) rotationally about the Z-axis. These adjustments are used to maneuver the mounted drill to an angular approach to the ground underneath the drill assembly for drilling micropiles according to a designed matrix.

The drill assembly of the '123 patent has some benefits in that it permits angular drilling at various angles on difficult to access terrain. However, it only provides three degrees of freedom, therefore limiting the adjustments that can be made. It must therefore be repositioned more frequently to reach all the desired locations for drilling. In addition, though its parts are lightweight enough to be flown to and assembled at the difficult to access work site, with the exception of the platform and legs which come pre-attached, it discloses building substantially the entire assembly piece by piece in the field. This requires multiple trips for transporting the various components which is not very efficient. It also requires special tools to attach the centering ring and rotating slide base to securely mount them in a way that permits the translational and rotational adjustment of these component parts, which are mounted sequentially on top of one another in stacked parallel planes. This makes assembly complicated and tedious, particularly because the centering ring must be adjusted in position before being secured in place. It also limits the degrees of freedom for adjustments to the drill position.

There is still a need for a drill rig that can be easily and efficiently transported to a remote or difficult to access work site, and that can be easily assembled in the field. It is also desired to have more degrees of freedom to increase the usefulness and flexibility of such a drill rig.

SUMMARY

An adjustable drill rig is disclosed which addresses these needs. Specifically, the adjustable drill rig of the present invention is provided for drilling and installing foundational micropile matrices in locations with difficult access. The adjustable drill rig is provided in two frames that are sufficiently lightweight they can each be flown to a remote work site, such as by helicopter, thus requiring only two trips for transporting the drill rig. The frames are easily joined in the field without the need for complex tools or specialized knowledge. Notably, the adjustable drill rig provides five (5) degrees of freedom along five different planes with which to adjust the drill head, allowing for drilling at a multitude of angles, such as up to 30° in some embodiments, in any direction and from any starting location within a drill area defined by the platform. Various adjusters are independently and selectively activated to adjust the drill head mounted on a mast translationally along the X-, Y- and Z-axes and rotationally about the X- and Y-axes within the five planes to achieve these five degrees of freedom.

Specifically, a platform is attached to legs that are each independently adjustable to level the platform regardless of the unevenness, grade or incline of the terrain. The platform defines an open drill area therein through which the drill will access the ground for drilling. Arms extend between legs on opposite sides of the platform and a crossbar extends between the two arms. At least one of the arms as well as the crossbar each includes a bushing slidably mounted and movable there along for adjustment along the X-axis and Y-axis. Adjusters for each, which are preferably linear extension motors such as hydraulic motors, extend and contract to direct the translational motion along the X- and Y-axes, respectively. Each of these adjusters directs movement along half of the defined drill area in the relevant direction when mounted in a first position but may be switched to the opposite side of the drill rig easily and quickly by selective mounting points, such as through quick release pins, to access the other half of the defined drill area along the respective axis. This keeps the weight of the drill rig down and further does not require complex or specialized tools or knowledge to reposition the X- and Y-axis adjusters in the field when so desired.

Additional adjusters are also provided for rotation about the X-axis and Y-axis, respectively. These may be linear or rotational motors. They are mounted to the crossbar bushing, to which a drill head is also mounted through a mast and mounting plate. Accordingly, movement of the crossbar bushing similarly moves the position and angle of the drill head where the drill will attach, thus affecting the position, angle and approach of the drill. An additional adjuster is provided for linear translation along the Z-axis, which is mounted to the mast and moves the mast linearly along the Z-axis. The height of the drill head may thus be adjusted to further change the approach of the drill.

The legs and platform form a support frame, and the remainder of the components form a translational frame. Each sub-assembly may be separately transported to the drill site, such as by helicopter. The support frame is positioned first, and the platform is preferably leveled by adjusting each leg independently. The translational frame is then positioned on top of the first, with the arms of the translational frame attaching to the tops of the legs of the support frame. The arms are secured to the legs by a simple connector, such as a clamp that may be screwed or bolted to form the secure connection. In this manner, the entire adjustable drill rig may be easily assembled in the field without the need for special tools or expertise. When the drilling is completed, the adjustable drill rig may be just as easily disassembled by removing the clamps.

The adjustable drill rig, with its particular features and advantages, will become more apparent from the following detailed description and with reference to the appended drawings.

DESCRIPTION OF THE DRAWINGS

Like reference numerals refer to like parts throughout the several views of the drawings.

DETAILED DESCRIPTION

As shown in the accompanying drawings, the present invention is directed to an adjustable drill rig 10 that provides five degrees of freedom in five planes for the selective adjustment of the drill head, each adjustable separately and independently of the other degrees of freedom. This adjustable drill rig 10 therefore enables drilling at a plurality of angles within a three-dimensional cone under the rig, such as but not limited to up to 30 degrees relative to a vertical reference axis 12, which is perpendicular to the platform 120 of the adjustable drill rig 10 and preferably is parallel to the force of gravity, as discussed in greater detail below. The adjustable drill rig 10 may be used with any suitable drill for the purpose of various types of drilling, such as but not limited to drilling and installing foundational micropile matrices. Because of the high degree of selective adjustability, the adjustable drill rig 10 of the present invention is ideal for drilling at locations with difficult access or uneven terrain which would make the use of other customary drill rigs unsafe, dangerous or inaccessible.

Figure 1:
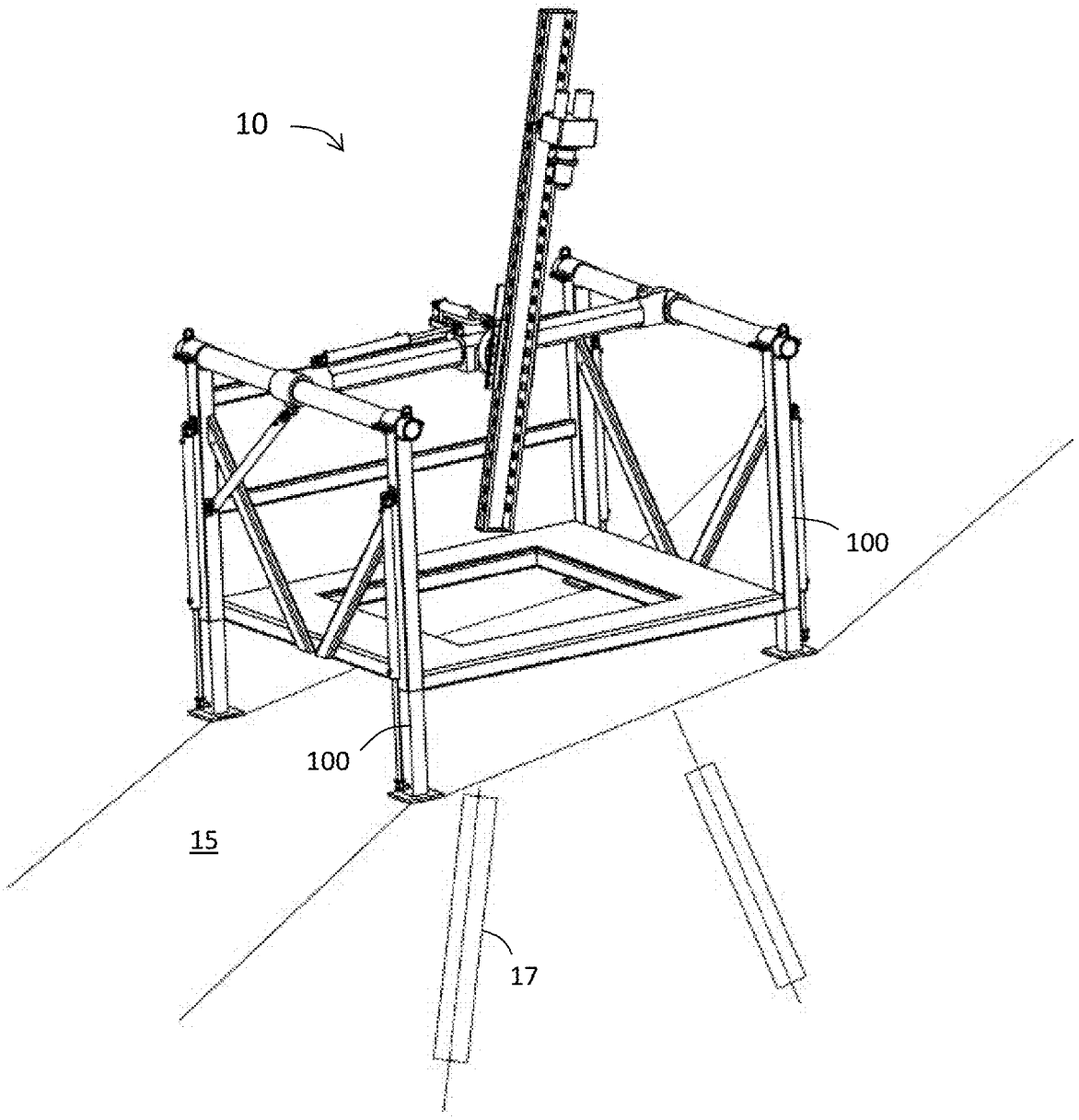
FIG. 1 is a front perspective view of one embodiment of the adjustable drill rig of the present invention, shown on uneven terrain.

For example, as shown in FIG. 1, the adjustable drill rig 10 of the present invention may be used for subterranean drilling, such as to establish micropiles 17 which will stabilize building structures as a foundation where surface-level spread foundations are not possible due to geographical limitations, such as but not limited to incline, likely soil erosion and others. Though described in terms of micropile drilling, the present adjustable drill rig 10 is also capable of drilling other types of subterranean drill holes at an angle relative to the surface of a particular location. The adjustable drill rig 10 includes a plurality of legs 100 which are each independently adjustable to accommodate uneven or angled terrain, such as an inclined ground 15 depicted graphically in FIG. 1.

Figure 2:
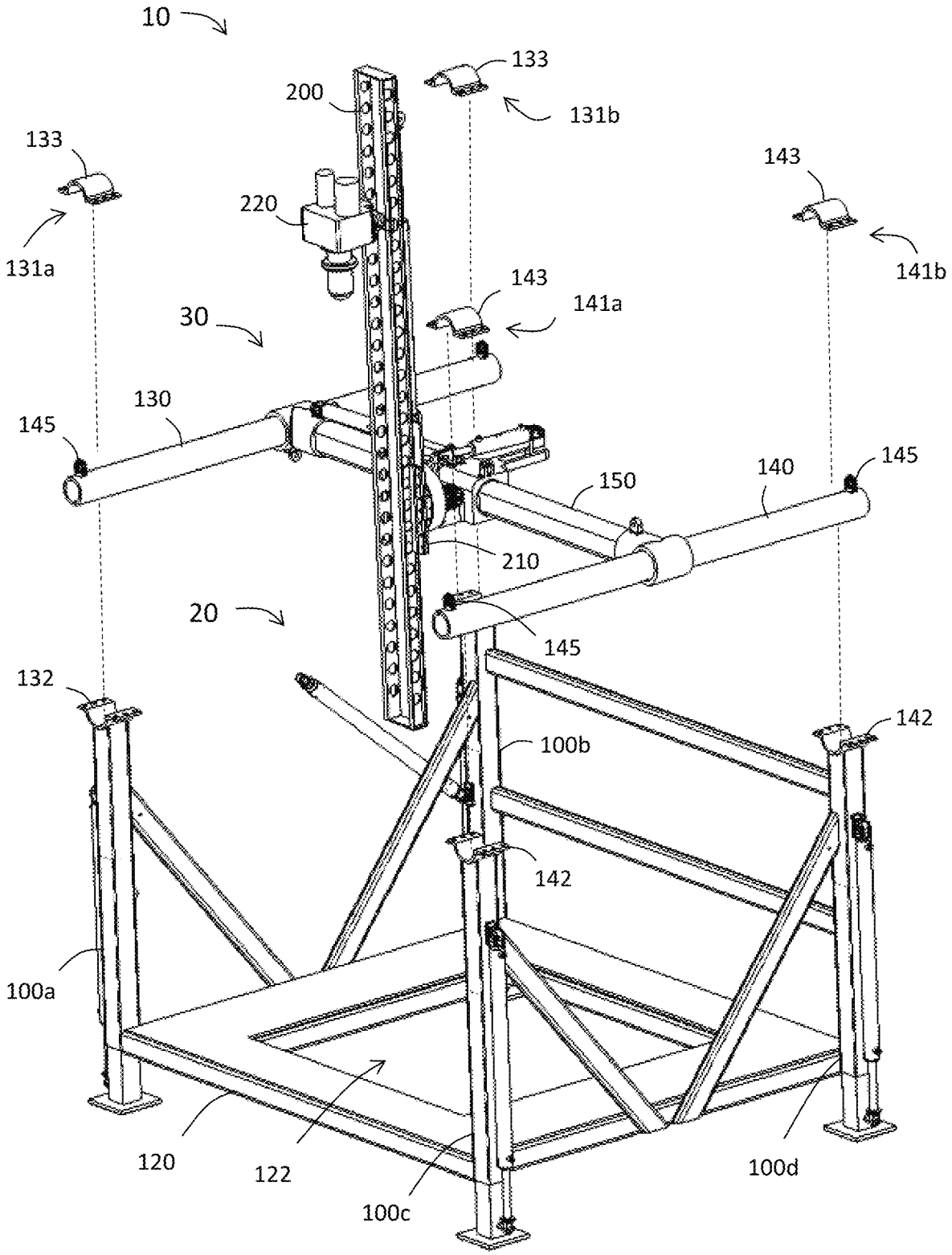
FIG. 2 is a front exploded view of the adjustable drill rig of FIG. 1, showing the support frame and translational frame.

The adjustable drill rig 10 is also easily assembled in the field, even in difficult to access locations that may not be accessible by road. In such locations, the adjustable drill rig 10 may be flown in, such as by helicopter or other air transportation, in sub-assemblies. Therefore, the adjustable drill rig 10 is made of materials and is sized and dimensioned to promote portability and ease of transport. As shown in FIG. 2, the adjustable drill rig 10 includes a support frame 20 forming the bottom or ground contacting portion of the rig and a translational frame 30 which attaches to the support frame 20 for use. The frames 20, 30 are preferably transported separately, with the support frame 20 being transported to the drill site or location first. The support frame 20 includes the legs 100 of the adjustable drill rig 10, connected by a platform 120. In at least one embodiment, the support frame 20 is transported to the drill site with the legs 100 pre-set to approximate the geographical relief and/or terrain of the drill site, such as based on geological survey and/or testing of the drill site conducted as part of assessing the drill site. The legs 100 may be preset for approximate ground or terrain conditions for safety reasons, so the support frame 20 is relatively stable when placed.

The support frame 20 is lowered into position over the desired drill site, with an open drilling area 122 defined within the platform 120 positioned over the desired drill site. In at least one embodiment, as shown here, the platform 120 may be sized to accommodate a drilling area 122 measuring approximately 5 feet by 5 feet, although other sizes and shapes of the drilling area 122 and platform 120 are also contemplated herein. Adjustments to each leg 100 may be made as needed once in place, to fine tune the positioning of the support frame and preferably level the platform 120, as discussed below, despite the terrain. Once in place, the translational frame 30 may be flown in and lowered onto the translational frame 20. Chains may connect to transportation points 145 on the translational frame to enable the transportation of the translational frame 30, which may be removed once the translational frame 30 is in place. The translational frame 30 includes a first arm 130, second arm 140, a crossbar 150 extending therebetween, a mast 200 vertically mounted to the crossbar 150 through a mounting plate 210, and a drill head 220. It is the various components of the translational frame 30 that provide the five degrees of freedom for the drill head, and therefore, for the drill.

The first and second arms 130, 140 connect to the legs 100 to attach the translational frame 30 to the support frame 20. Arm connectors 131, 141 may be used to connect the arms 130, 140 to the legs 100. For instance, first arm connectors 131*a*, 131*b* may be used to connect the first arm 130 to legs 100*a*, 100*b* and second arm connectors 141*a*, 141*b* may be used to connect the second arm 140 to legs 100*c*, 100*d*. Each of the arm connectors 131, 141 may include a first portion 132, 142 secured to the corresponding leg 100 and a second portion 133, 143 selectively movable relative to and/or removable from the corresponding first portion 132, 142. For instance, in at least one embodiment as shown in FIG. 2, the second portion 133, 143 may be fully separable from the corresponding first portion 132, 142. In other embodiments, the second portion 133, 143 may be at least partially secured to and movable relative to the corresponding first portion 132, 142, such as about a hinge providing clam-shell action movement for opening and closing the second portions 133, 143 relative to the first portions 132, 142. Accordingly, the first and second arm connectors 131, 141 may be clamps, brackets, or other similar connecting structures.

The first and second portions 132, 133 of each of the first arm connectors 131*a*, 131*b* collectively at least partially surround the first arm 130 to secure the first arm 130 to legs 100*a*, 100*b*, as shown in the exploded view of FIG. 2. Securing members such as but not limited to screws and bolts, hold the first and second portions 132, 133 together with the first arm 130 secured therebetween. Similarly, the first and second portions 142, 143 of each of the second arm connectors 141*a*, 141*b* collectively surround at least a portion of the second arm 140 to secure the second arm 140 to legs 100*c*, 100*d*, as shown in FIG. 2. Securing members hold the first and second portions 142, 143 together with the second arm 140 secured therebetween. These securing members provide a firm and secure connection but are preferably reversible, allowing the first and second arms 130, 140 to be released when desired to allow for disassembly of the adjustable drilling rig 10 into the respective frames 20, 30 for transport from the drill site once the drilling is complete.

Figure 3:
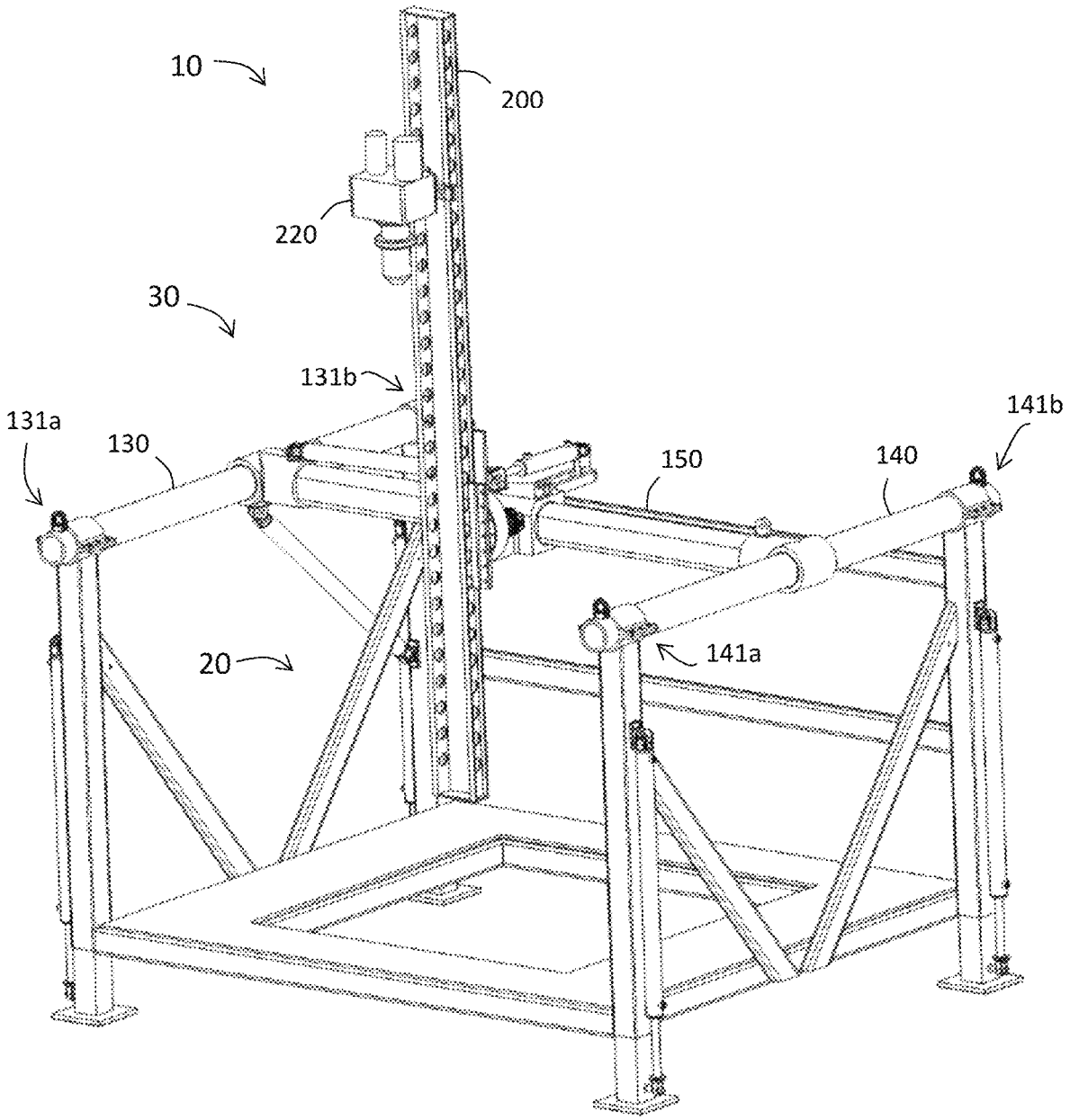
FIG. 3 is a front perspective view of FIG. 2 when assembled.
Figure 4A:
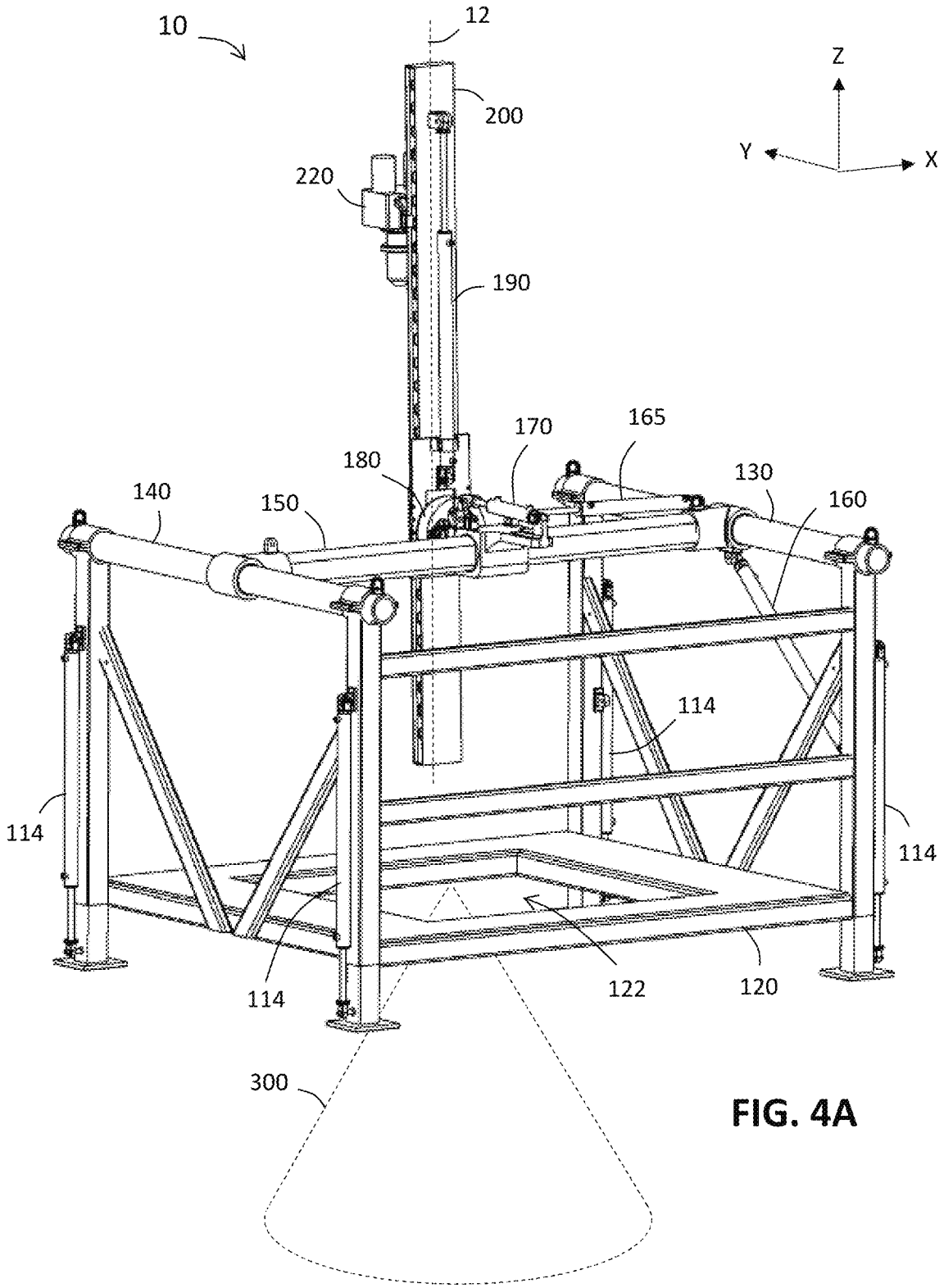
FIG. 4A is a rear perspective view of the adjustable drill rig of FIG. 1 showing the various adjusters and the three-dimensional drilling cone enabled by the adjustable drill rig.

Once the translational frame 30 is secured to the support frame 20, the adjustable drill rig 10 is fully assembled, as shown in FIGS. 3 and 4A. For instance, FIG. 3 shows the assembled adjustable drill rig 10 from a front perspective view, which shows the drill head 220 and mast 200. The drill head 220 is sized and configured to receive a drill (not shown) thereon. It is shown here is a representative drill head 220 since its actual configuration may vary depending on the type of drill to be used. The mast 200 is used to mount the drill head 220 to the rest of the adjustable drill rig 10 and convey the adjustments in position to the drill head 220, and therefore, to the drill.

The adjustable drill rig 10 includes various adjusters to effectuate the selective adjustment of the position and angle of the drill head 220, and therefore drill, with five degrees of freedom, both linearly along the X-, Y- and Z-axes and rotationally about the X- and Y-axes. As used herein, the "X-axis" or "X-axis direction" is defined as parallel to the length of the crossbar 150 of the translational frame 30; the "Y-axis" or "Y-axis direction" is defined as parallel to the length of the first and second arms 130, 140 of the translational frame 30; and the "Z-axis" or "Z-axis direction" is defined as perpendicular to the surface of the platform 120 of the support frame 20. These axes are also labeled in FIGS. 4A-4E. The adjusters are shown in the rear perspective view of the assembled adjustable drill rig 10 of FIG. 4A. Specifically, the adjustable drill rig 10 includes a Y-translational adjuster 160 which is operable to move the drill head 220 linearly along the Y-axis; an X-translational adjuster 165 operable to move the drill head 220 linearly along the X-axis; an X-rotational adjuster 170 operable to move the drill head 220 rotationally about the X-axis; a Y-rotational adjuster 180 operable to move the drill head 220 rotationally about the Y-axis; and a Z-translational adjuster 190 operable to move the drill head 220 linearly along the Z-axis. With these five adjusters, each separately and independently operable as described below, the drill head 220 may be adjusted to any position along the arms 130, 140 and crossbar 150, and to a variety of angles relative to the reference axis 12, such as but not limited to angles of up to 30 degrees. Other angles, including greater angles, are also contemplated and within the spirit of this adjustable drill rig 10 and may in some instances bring the drill head 220 outside the perimeter of the support frame 20, so long as the drill may still access the drilling area 122. In addition, it should be appreciated that the adjusters move various parts of the frames 20, 30, such as the legs 100 and crossbar 150, as well as the mast 200 to position the drill head 220 at any location within boundaries of the support frame 20. With the translational movements and rotational movements the various adjusters collectively provide, the drill mounted on the drill head 220 may reach any point in the ground within a three-dimensional cone 300 under the drilling area 122 defined within the platform 120, as shown in FIG. 4A, allowing holes for micropiles to be drilled at a wide variety of angles, positions and trajectories. Thus, an entire micropile matrix can be drilled, even at angles on uneven or inaccessible terrain, using this single adjustable drill rig 10 without having to relocate the drilling rig 10.

The leg adjusters 114 of the support frame 20 are primarily to accommodate the terrain and geography of the drill site and to level the platform 120. However, the leg adjusters 114 may also be used to increase the overall height of the adjustable drill rig 10, providing additional linear translational adjustment along the Z-axis such as may be needed to achieve even greater drill angles.

Figure 4B:
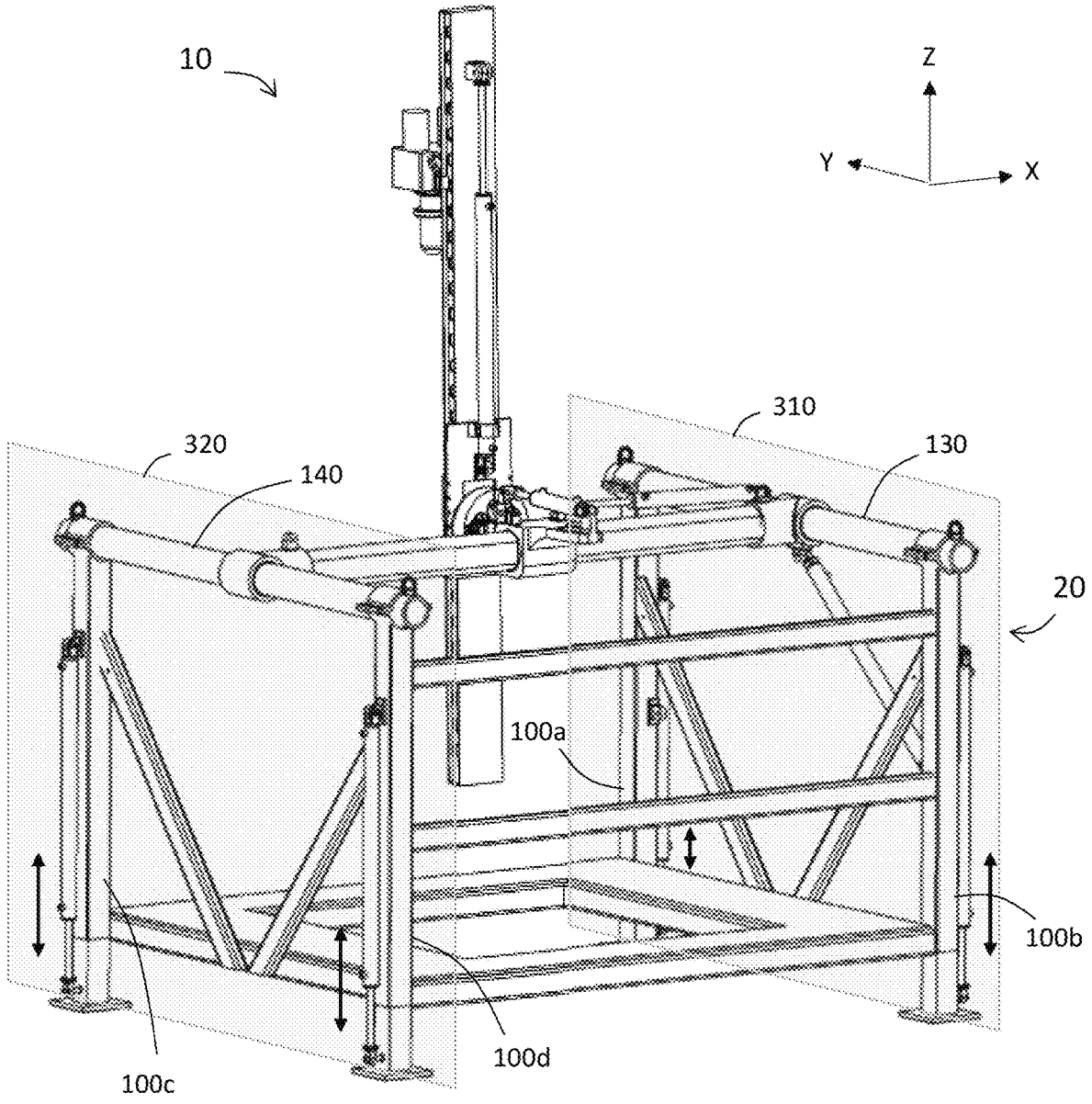
FIG. 4B is a rear perspective view of the adjustable drill rig of FIG. 4A showing the first and second planes of adjustment and translational movement along the Z-axis.

The various adjusters 114, 160, 165, 170, 180, 190 selectively move the support frame 20, translational frame 30 and/or mast 200 along various planes coincident with the X-, Y- and Z-axes. For instance, the legs 100 are selectively adjustable to move the support frame 20 in the Z-axis direction along a first plane 310 or second plane 320, as shown in FIG. 4B. First and second planes 310, 320 are each defined between different legs 100 of the support frame 20. For instance, the first plane 310 may be defined between the legs 100*a*, 100*b* that support the first arm 130. The second plane 320 may be defined between the legs 100*c*, 100*d* that support the second arm 140. The first and second planes 310, 320 also extend in the Z-axis direction, as shown in FIG. 4B.

Figure 4C:
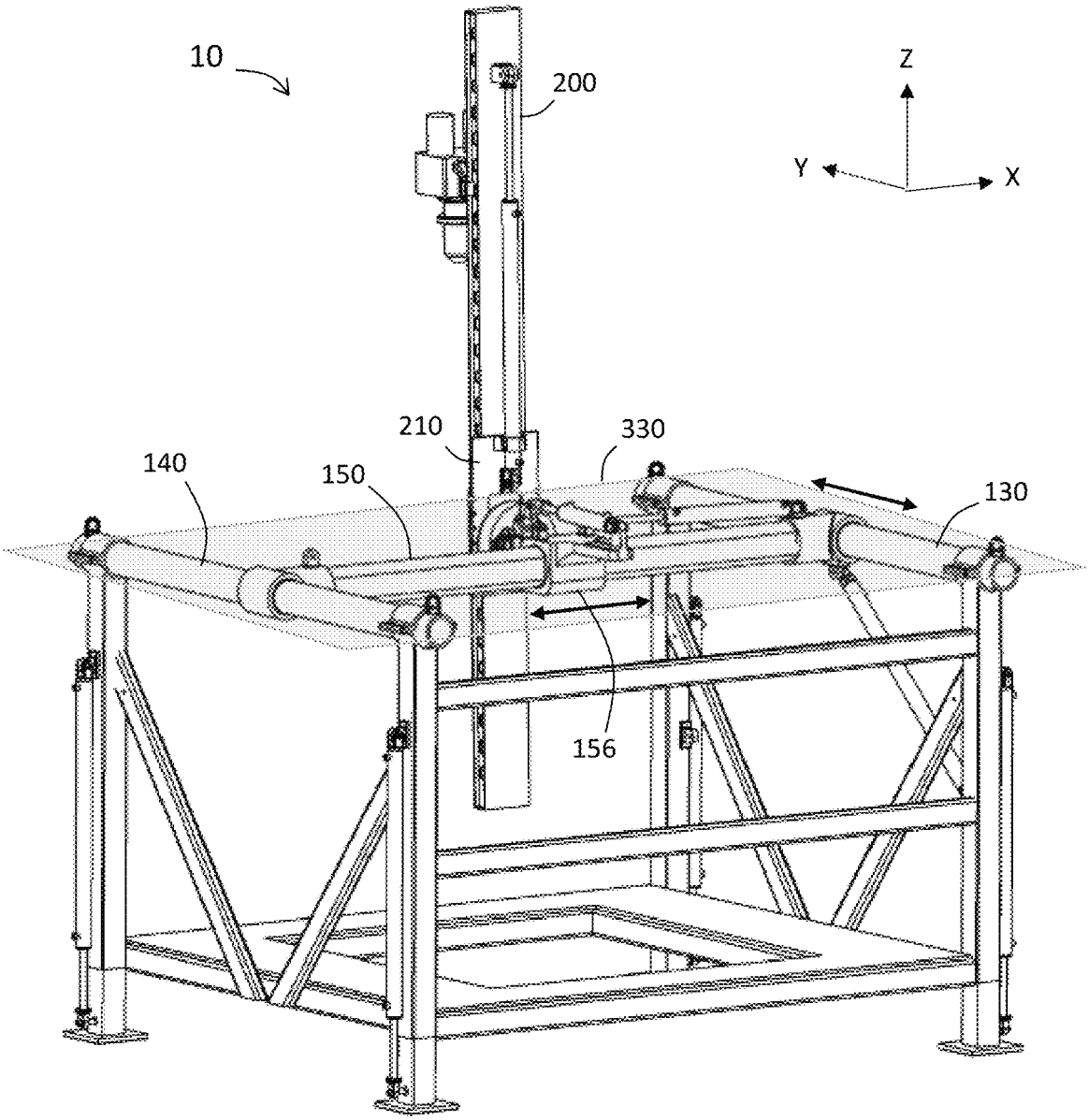
FIG. 4C is a rear perspective view of the adjustable drill rig of FIG. 4A showing the third plane of adjustment and translational movement along the X- and Y-axes.

In addition, at least a portion of the translational frame 30 is selectively movable in the X- and Y-axis directions along a third plane 330, as shown in FIG. 4C. The third plane 330 may be defined as the plane that extends along the collective surface of the first arm 130, second arm 140 and crossbar 150, and which is perpendicular to the first and second planes 310, 320. Accordingly, the third plane 330 extends in both the X- and Y-axes. The crossbar 150 is movable along the third plane 330 in the Y-axis direction. The mast 200 also moves along with the crossbar 150, being attached thereto by the mounting plate 210. Additionally, a crossbar bushing 156, discussed in greater detail below, is movably mounted to the crossbar 150 and is selectively movable along the third plane 330 in the X-axis direction.

Figure 4D:
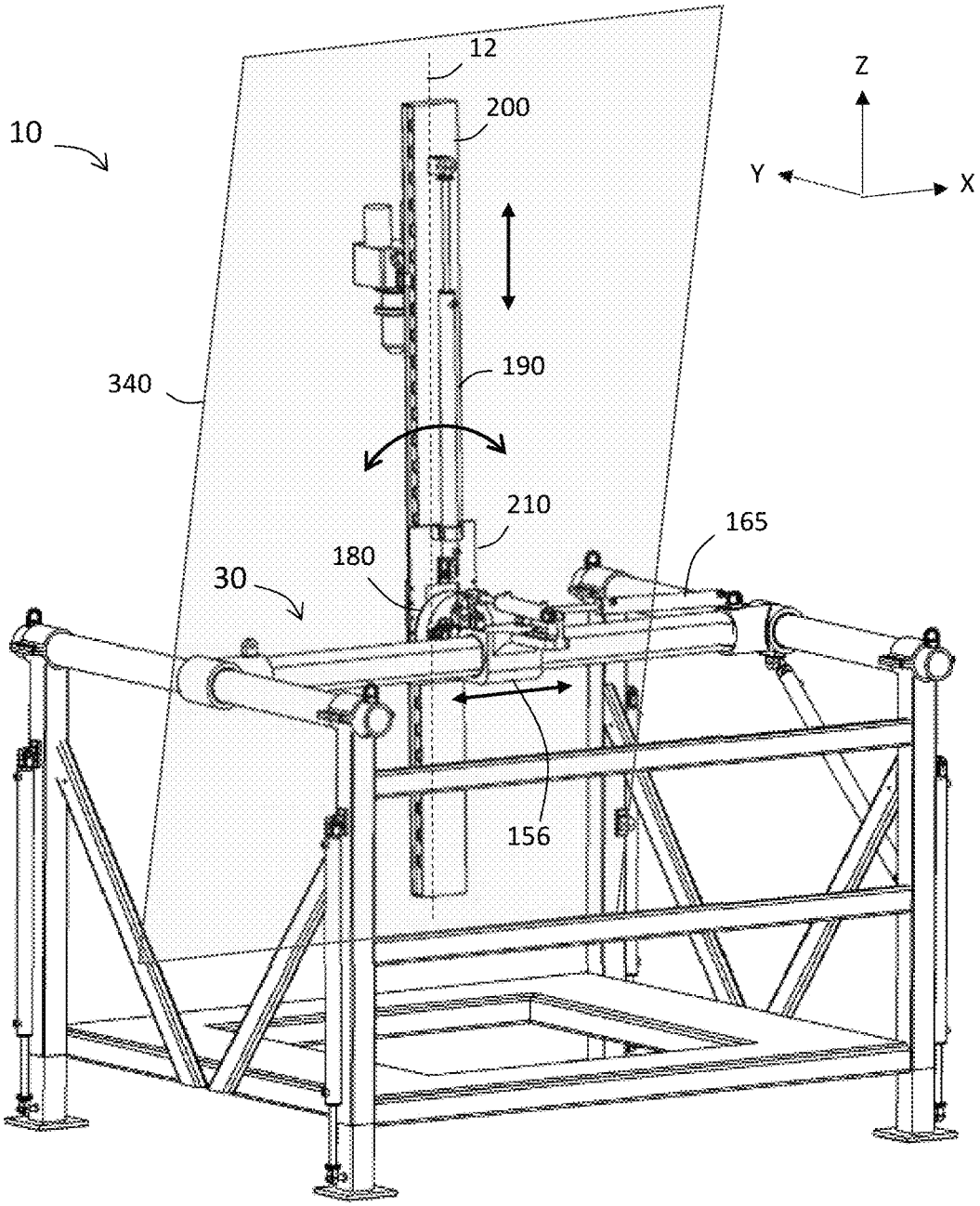
FIG. 4D is a rear perspective view of the adjustable drill rig of FIG. 4A showing the fourth plane of adjustment, translational movement along the X- and Z-axes and rotational movement about the Y-axis.

The mast 200 is slidably mounted to the mounting plate 210, and therefore to the translational frame 30. It is selectively movable translationally along a fourth plane 340 as shown in FIG. 4D. The fourth plane 340 is defined as extending the length of the mast 200 and intersecting the third plane 330. Accordingly, the mast 200 may move translationally along the fourth plane 340 in the Z-axis direction as it slides in relation to the mounting plate 210 when the Z-translational adjuster 190 is activated, and in the X-axis direction as the crossbar bushing 156 moves along the crossbar 150 and the X-axis when the X-translational adjuster 165 is activated. The mast 200 also moves rotationally within the fourth plane 340 by movement of the Y-rotational adjuster 180 to adjust the angle of the mast 200 relative to the reference angle 12 within the fourth plane 340.

Figure 4E:
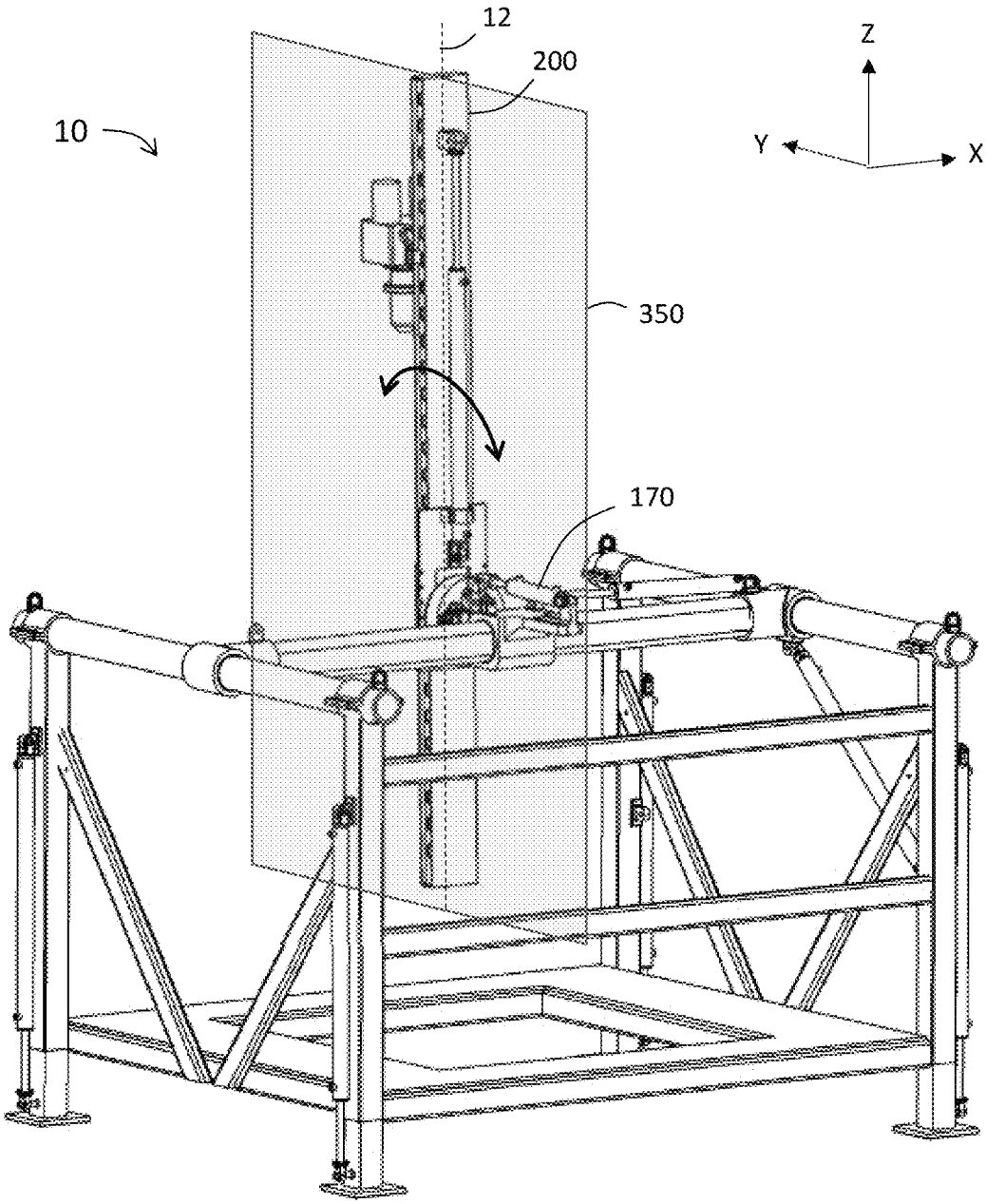
FIG. 4E is a rear perspective view of the adjustable drill rig of FIG. 4A showing the fifth plane of adjustment and rotational movement about the X-axis.

The mast 200 is additionally movable within a fifth plane 350 as shown in FIG. 4E. The fifth plane 350 is defined as extending the length of the mast 200 and intersecting each of the third and fourth planes 330, 340. The fifth plane 350 exists between the first and second planes 310, 320 and may be parallel to the first and second planes 310, 320 when the mast 200 is aligned with the reference axis 12, or may not be parallel to the first and second planes 310, 320 when the mast 200 deviates from the reference axis 12. The mast 200 is selectively movable rotationally within the fifth plane 350 about the X-axis by movement of the X-rotational adjuster 170.

The various adjusters 114, 160, 165, 170, 180, 190 may be linear or rotational in nature, and may be electronically, hydraulically, pneumatically or even manually operated, or combinations thereof throughout the adjustable drill rig 10. For instance, in at least one embodiment as shown in FIG. 4, the leg adjusters 114, Y-translational adjuster 160, X-translational adjuster 165, X-rotational adjuster 170 and Z-translational adjuster 190 may be shocks which are hydraulically operated and move by linear extension of a piston within a barrel. The Y-rotational adjuster 180, and in some embodiments the X-rotational adjuster 170, may be a rotary motor that is electrically driven, as described below. However, other combinations are also possible. Some or all of the various adjusters 114, 160, 165, 170, 180, 190 may be powered by a power unit (not shown) that is separate from the adjustable drilling rig 10 but in electronic, hydraulic or pneumatic communication with the relevant adjusters 114, 160, 165, 170, 180, 190. In at least one embodiment, the power unit may be an engine, such as but not limited to a gas or diesel engine, which may have any number of cylinders such as but not limited to 4, 6 or 8. In at least one embodiment, the power unit is a 4-cylinder diesel engine capable of providing 120-150 horsepower, and 150 horsepower in at least one embodiment. The power unit may connect to the adjustable drill rig 10 through electrical, electronic, hydraulic and/or pneumatic lines, such as cables or wires (not shown), to transmit electricity, fluid and/or gas, respectively, to the adjustable drill rig 10. In some embodiments, these lines or cables connect directly to each of the various adjusters 114, 160, 165, 170, 180, 190. In at least one embodiment, however, the cables or wires from the power unit connect to a manifold mounted in the adjustable drill rig 10, such as to the platform 120 or a leg 100. The manifold is in communication with each of the adjusters 114, 160, 165, 170, 180, 190 to provide electrical, hydraulic and/or pneumatic power as the particular adjuster 114, 160, 165, 170, 180, 190 requires. The various adjusters 114, 160, 165, 170, 180, 190 are moved according to operative instructions received from a control unit (not shown) which is separate from the adjustable drill rig 10 but in electronic communication with each of the adjusters 114, 160, 165, 170, 180, 190 either directly or through a connection to the manifold. Each of the adjusters will now be described in greater detail.

Figure 5:
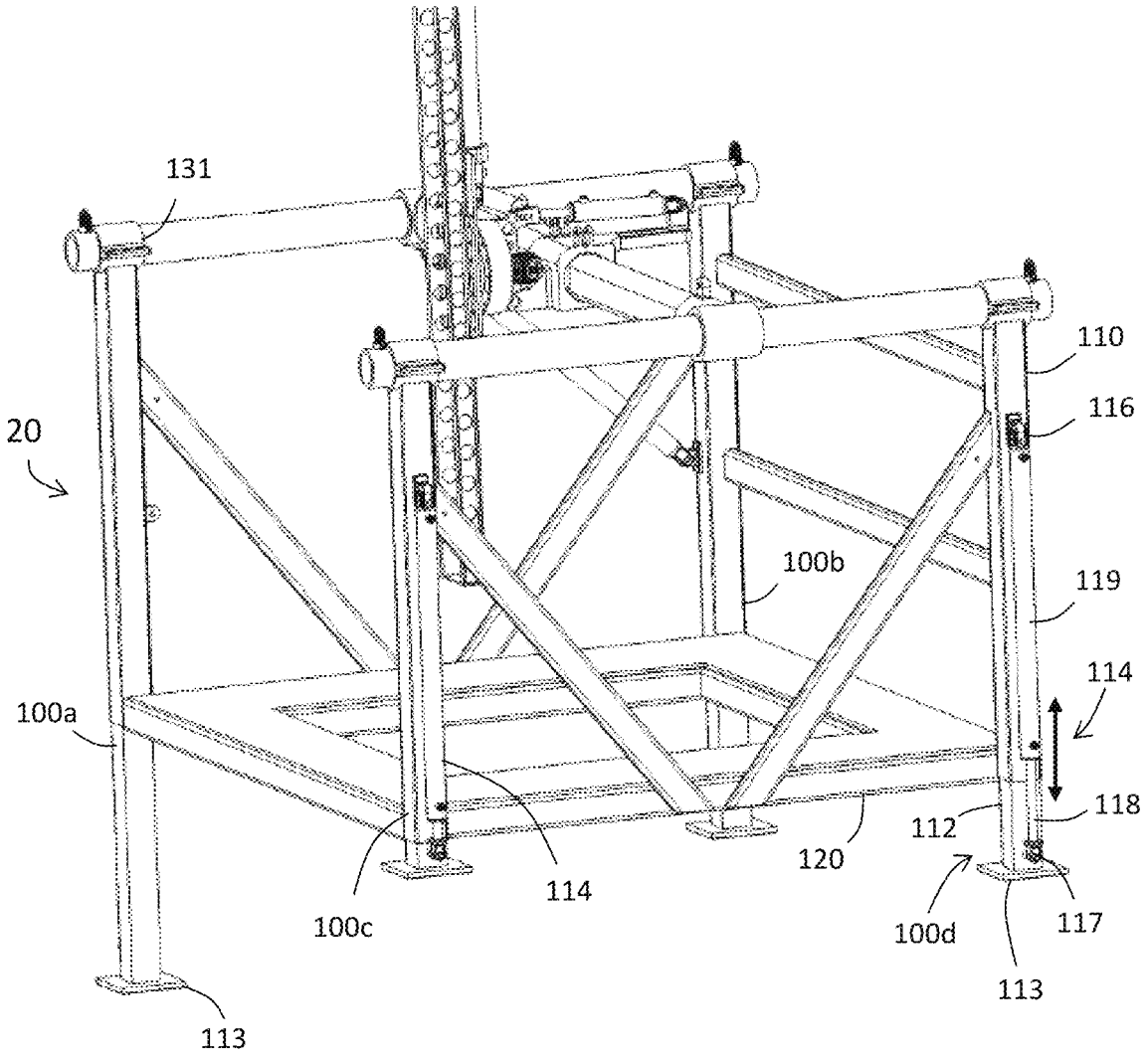
FIG. 5 is a side perspective view of the adjustable drill rig of FIG. 1 showing adjustment of the leg adjusters.

FIG. 5 shows more detailed view of the support frame 20, specifically the plurality of legs 100 movably attached to a platform 120. Each leg 100*a*, 100*b*, 100*c*, 100*d* is separately and independently moveable in relation to the others, to accommodate any terrain or ground incline and to level the attached platform 120 despite the angle, incline or unevenness of the terrain. Each leg 100 includes a first portion 110 and second portion 112 collectively making up the length of the leg 100, shown with respect to leg 100*a* for illustrative purposes though all legs 100 include respective first and second portions 110, 112. The first and second leg portions 110, 112 of each leg may be made of strong but light materials such as but not limited to steel or aluminum. The first portion 110 of each leg 100 is located at the top of the support frame 20. In at least one embodiment, one end of the first portion 110 of the leg 100 terminates in part of an arm connector 131, 141, such as the first portion 132, 142 of the arm connector as described above. The other end of the first portion 110 of the leg 100 terminates in abutting contact or overlapping with the second portion 112 of the leg 100 when fully collapsed. Accordingly, the adjacent ends of the first and second portions 110, 112 of each leg 100 may have a corresponding shape and/or dimension to facilitate flush seating of the first portion 110 of the leg 100 on the second portion 112 thereof when the leg 100 is fully collapsed.

The second portion 112 extends between the end meeting the first portion 110 and a foot 113 at the opposite end. The foot 113 is configured and dimensioned to be placed on the ground or terrain and to support the leg 100 and rest of the adjustable drill rig 10. Accordingly, in at least one embodiment the width of the foot 113 is at least as large as the width of the corresponding leg 100. As shown in FIG. 5, the foot 113 may have a larger width than the leg 100 and may have a planar configuration to distribute the weight of the adjustable drilling rig 10. In other embodiments (not shown), the foot 113 may have a smaller width than the corresponding leg 100, such as if the leg 100 and/or foot 113 tapers to a narrower width such that the portion of the foot 113 contacting the ground or terrain is smaller or narrower than the leg 110. Indeed, in some such embodiments, the foot 113 may come to a point or substantially to a point where it contacts the ground. Such narrower dimensions would allow the foot 113 to contact the ground despite uneven terrain lacking large areas for wider or flatter footholds, such as rocky or irregular terrain, brush or roots extending through the ground surface.

Each leg 100 includes a leg adjuster 114 attached to the leg 100 that is movable relative to the leg 100 to similarly move the leg 100 in the Z-axis direction. For instance, the leg adjuster 114 may include a first attachment point 116 where the leg adjuster 114 attaches to the first portion 110 of the leg 100, and a second attachment point 117 where the leg adjuster 144 attaches to the second portion 112 of the leg 100, as shown in FIG. 5, though in other embodiments, the first and second attachment points 116, 117 may connect to other portion 112, 110 of the leg 100. Accordingly, the leg adjuster 114 is attached to the leg 100 so it spans between the first and second portions 110, 112 of the leg 100. The leg adjuster 114 may therefore have an elongate configuration and may extend along at least a portion of the length of the leg 100 in proximity to the junction of the first and second portions 110, 112. The attachment points 116, 117 may be located anywhere along the leg adjuster 114, though they may preferably be located at or near the terminal ends of the leg adjuster, as shown in FIG. 5. The attachment points 116, 117 coordinate with matching attachments on the leg 100 to connect to the first and second leg portions 110, 112. For instance, the attachment points 116, 117 and coordinating attachments on the leg 100 may be brackets, pin connectors, clamps, screws, bolts, or other similar structure for secure attachment. In at least one embodiment, the attachment points 116, 117 may be screwed or bolted to the corresponding leg portions 110, 112.

Each leg adjuster 114 linearly extends and contracts when activated, producing linear translational movement of the attached leg 100 along the Z-axis and the first or second plane 310, 320. Because one part of the leg adjuster 114 is secured to the first portion 110 of the leg 100 and another part of the same leg adjuster 114 is secured to the second portion 112, when the leg adjuster 114 extends or contracts, it moves at least one of the first and second portions 110, 112 with it. In at least one embodiment, shown in FIG. 5, the first portion 110 is moved linearly, either extending upward (away from the second portion 112 and foot 113) or contracted downward (toward the second portion 112 and foot 113) when the leg adjuster 114 is activated, and follows the direction of movement of the leg adjuster 114. This movement increases or decreases the distance between the first and second portions 110, 112 and therefore the overall length of the leg 100 and thus height of the support frame 20.

In some embodiments, at least one of the first and second portions 110, 112 of the leg 100 may be hollow, and the other portion of the leg 100 may telescope within the hollow interior of the first or second portion 110, 112 of the leg. This inner telescoping leg portion provides structural stability to the leg 100 and keeps the leg 100 aligned when the first and second leg portions 110, 112 are linearly translated relative to one another by the leg adjuster 114. In such embodiments, the hollow interior of the first and/or second leg portions 110, 112 has a larger dimension than the telescoping inner portion, such that the inner portion is retained within the hollow of the leg 100. Either the outer hollow portion or inner telescoping portion may be movable relative to the other, such as by slidable movement during linear translation. In at least one embodiment, the inner telescoping portion remains stationary when the hollow outer portion of the leg 100 is moved by the leg adjuster 114.

As mentioned previously, each leg adjuster 114 may be a hydraulic, pneumatic or electronic motor, and may be the same or different types from one another. In the embodiment shown in FIG. 5, the leg adjusters 114 are hydraulics comprised of a piston 118 and cylinder 119. For instance, in at least one embodiment the cylinder 119 may have a diameter in the range of 3-4 inches, preferably about 3 inches. The length of the cylinder 119 will depend on the height needed for the rig 10 based on the specifications of the drill site location and/or size and configuration of micropile array to be drilled. The cylinder 119 preferably has a fixed length and a travel distance is provided for the leg adjuster 114 by the movement of the piston 118. For instance, in some embodiments, the cylinder 119 may have a length of up to or about 20 inches, with a travel distance of the leg adjuster 114 being up to about 8-10 inches. In this example, the leg adjuster 114 therefore may have a length of up to 30 inches fully extended and 12 inches fully compressed. In other embodiments, however, each leg adjuster 114 may have a travel length of up to 24 inches and a cylinder 119 length up to 48 inches, thus leading to a possible 72 inches maximum extension and 24 inches maximum compression. These are but a few non-limiting examples. The leg adjuster 114 may have suitable power capacity and operability for the size and weight of the rig 10. For instance, in at least one embodiment, each leg adjuster 114 may be a hydraulic having up to 3000 psi capacity and operative in the range of about 500-1000 psi, though other ranges are also possible. When activated, the pressurized hydraulic fluid moves the piston 118 within and relative to the cylinder 119. Depending on the direction of hydraulic fluid flow as directed by the hydraulic pump, the piston 118 may move further out of the cylinder 119 to increase or extend the length of the leg adjuster 114, or further into the cylinder 119 to decrease or contract the length of the leg adjuster 114. The length of the leg 100 is similarly increased (extended) or decreased (contracted) consistent with the movement of the piston 118 relative to the cylinder 119.

As mentioned previously, each of the legs 100 may be adjusted separately and independently of one another by selectively activating the desired corresponding leg adjuster 114. Accordingly, each leg 100 may be adjusted to a different length than the remaining legs 100, such as shown for legs 100*a*, 100*c* and 100*d* in FIG. 5, and some legs 100 may have the same length as others, such as legs 100*b* and 100*c* in FIG. 5 while still others have differing lengths. The leg adjusters 114 may be operated one at a time or simultaneously in any combination and by any amount to change the length of the legs 100 and correspondingly level the platform 120. In some embodiments, "level" may mean the platform 120 is parallel to the surface of the ground directly underneath the platform 120. In other embodiments, "level" may mean perpendicular to the direction of gravitational force, regardless of the slope or incline of the ground or terrain. The platform 120 may be leveled on various inclines, such as but not limited to inclines of up to 24°. As seen in FIG. 5, the platform 120 is secured to the first portion 110 of each of the legs 100, such as but not limited to by welding, screws and bolts. Accordingly, as the distance between the first and second portions 110, 112 of the legs 100 is adjusted, the platform 120 rises and falls with the first portion 110 of the legs 100. Each leg 100 may be adjusted independently of the others to achieve the desired level of the platform 120. The leg adjusters 114 may be operated simultaneously or one at a time to accomplish this adjustment and leveling.

Figure 6:
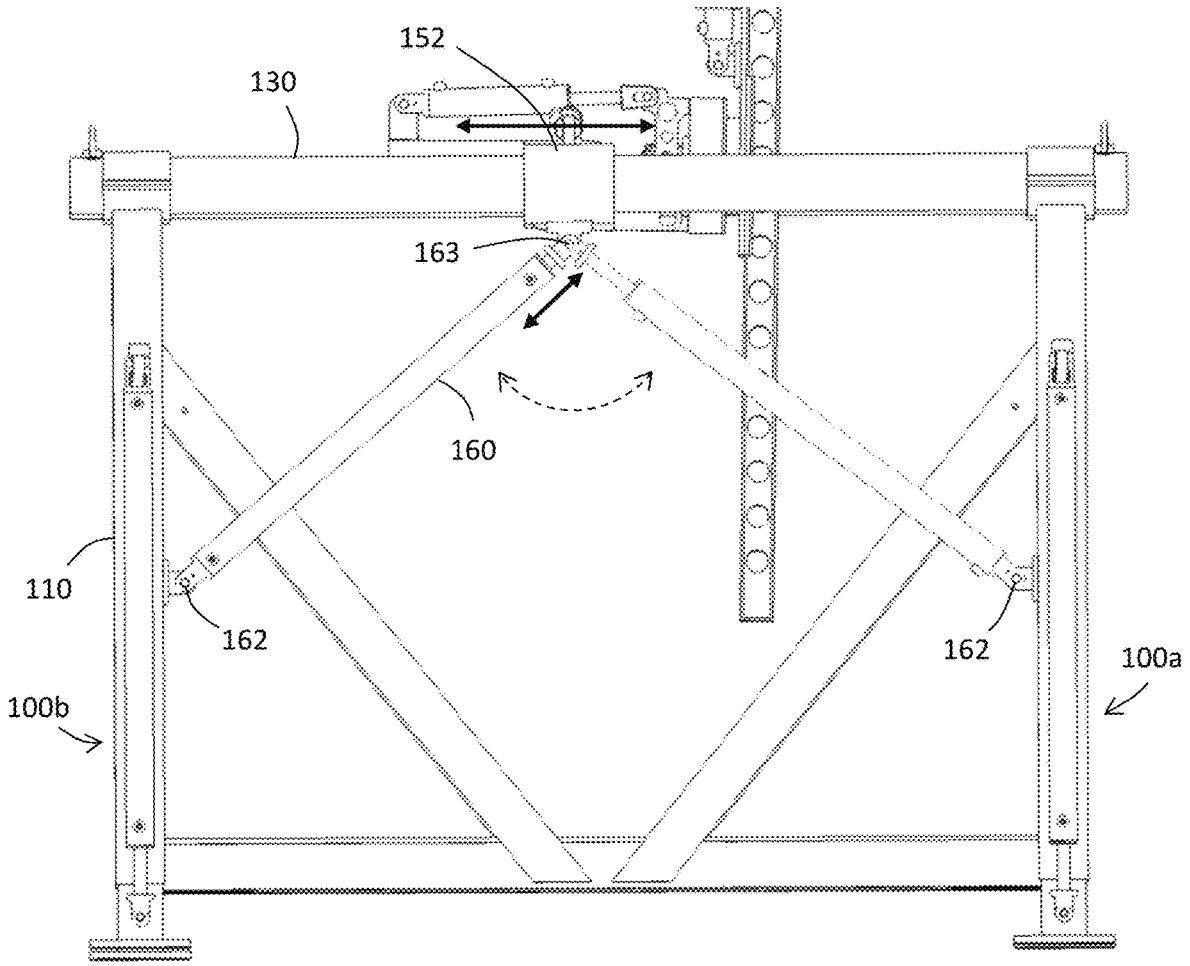
FIG. 6 is a side elevation view showing the Y-translational adjuster for movement along the Y-axis.

The adjustable drill rig 10 also includes at least one Y-translational adjuster 160, as shown in FIG. 6. The Y-translational adjuster 160, like the other adjusters discussed herein, may be a hydraulic, pneumatic, electronic or manually operated motor. In the embodiment shown in FIG. 6, the Y-translational adjuster 160 is a hydraulic motor, which may be similar to that discussed above. It may be composed of a cylinder and piston, with the cylinder having a diameter in the range of about 3-4 inches, preferably about 3 inches in at least one embodiment. The Y-translational adjuster 160 may have a travel distance of up to about 8-10 inches. It may also have a power capacity of up to about 3000 psi and may be operable in the range of about 500-1000 psi, though other ranges are also possible. The Y-translational adjuster 160 includes a first mounting point 162 at one end and a second mounting point 163 at the opposite end. These first and second mounting points 162, 163 may be located at terminal ends of the Y-translational adjuster 160, such as at a terminal end of the cylinder and a terminal end of the piston. The first and second mounting points 162, 163 may be mounting hardware for secure attachment, such as brackets and screws. In at least one embodiment, the first and second mounting points 162, 163 are brackets within which quick-release mounting hardware, such as a quick release pin, trailer hair pin, cotter pin is inserted to secure the connection, but which can easily be removed without the use of tools when connection is no longer desired.

Figure 7:
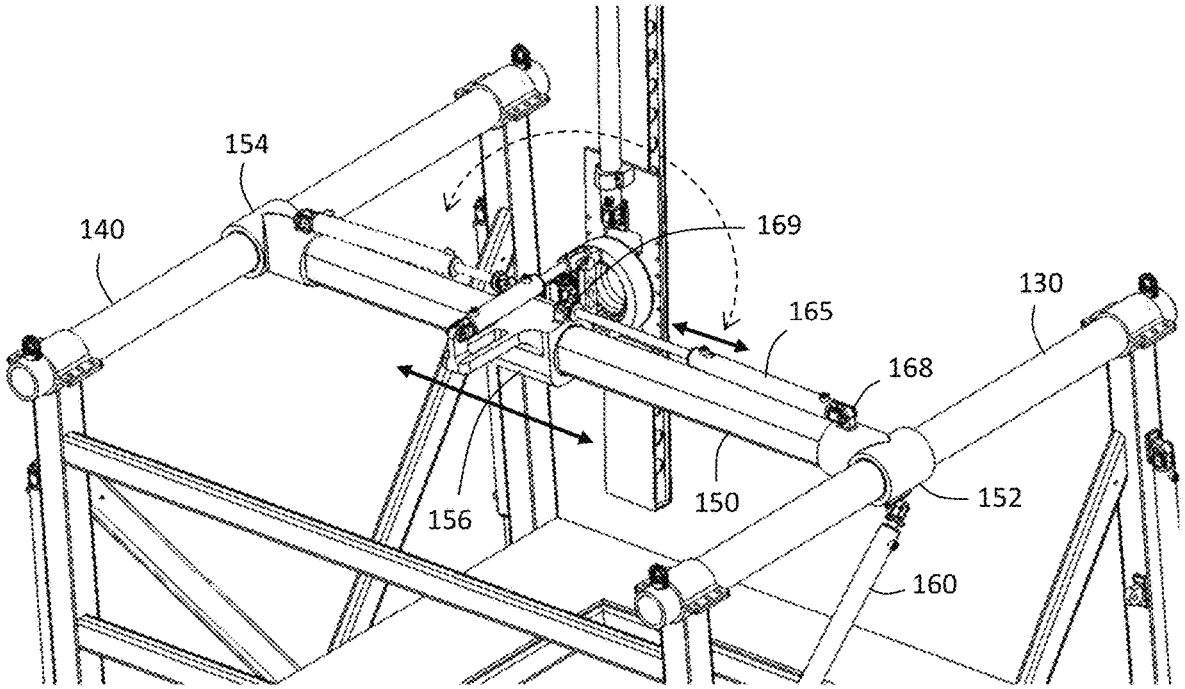
FIG. 7 is a rear perspective view showing the X-translational adjuster for movement along the X-axis.

The first mounting point 162 attaches the Y-translational adjuster 160 to a leg 100, specifically to a point along the first portion 110 of a leg 100. The first mounting point 162 may be located at any point along the first portion 110 of a leg 100 and to any of the legs 100. The second mounting point 163 connects to the first arm 130, preferably at a first arm bushing 152. The first arm bushing 152 includes a portion that at least partially surrounds the first arm 130 and another portion which may extend therefrom and receives one end of the crossbar 150, as shown in FIG. 7. In at least one embodiment, at least a portion of the first arm bushing 152 entirely surrounds the first arm 130 and is movable there along, such as by sliding. Accordingly, the first arm bushing 152 may have a shape and size similar to the diameter and outer circumference of the first arm 130 but is slightly larger than the outer circumference of the first arm 130 to allow clearance for smooth movement of the first arm bushing 152 along the arm 130. For instance, the first arm 130 may have an inner diameter in the range of about 2-3 inches, preferably about 2 inches, and an outer diameter in the range of about 3-4 inches, preferably about 3 inches in at least one embodiment. The inner diameter may be as large as possible while still giving the desired strength for the first arm 130, which will depend on the type of material used and its strength characteristics. The inner and outer diameters may also depend on the wall thickness of the first arm 130, which may be in the range of about 0.25-1 inch, and preferably about 0.5 inch in at least one embodiment. The thickness of the wall will depend on the material used for the first arm 130, with stronger materials allowing for thinner wall thickness. For instance, the first arm 130 may be made of 4130 chromoly steel, stainless steel, or other steels and/or metals. The first arm 130 may include a coating or be nickel-, chrome- or nitrile-plated on the outer surface of the first arm 130 to improve durability and quality. In some embodiments, the first arm 130 may have a high-quality surface finish, such as to reduce surface roughness and improve the ability of coatings to adhere to the material, the degree of which will depend on the material of the arm 130 and the particular coating or plating to be used. Once the coating or plating is applied, the outer surface of the first arm 130 may have an essentially immeasurable surface roughness. The first arm bushing 152 which translates over the first arm 130 may be made of durable metals having high yield strength, such as but not limited to 2024 aluminum or other types of aluminum on the outside, and brass, bronze or other metal alloy on the inside. In some embodiments, the outer surface of the first arm 130 may be lubricated, coated or impregnated with grease, such as industrial or automotive grease, or polytetrafluoroethylene ("PFTE") or other polymers or similar chemicals for improved mobility and durability while reducing wear on the arm 130. For example, in one embodiment, PFTE may be used in conjunction with a first arm 130 made of steel. Grease of either type may be used with first arm bushings 152 having brass or bronze inner surfaces. Grease may not be needed if PFTE is included in or on the outer surface of the first arm 130. These are a few non-limiting examples.

Returning to FIG. 6, with one end secured to leg 100*b* and the other end secured to the first arm bushing 152, the Y-translational adjuster 160 may be selectively activated to extend or contract in length, such as described above for the leg adjuster 114 and indicated by the arrow in FIG. 6. The Y-translational adjuster 160 may extend and contract according to its travel distance, which may be up to 24-48 inches in some embodiments, preferably up to about 24 inches in at least one embodiment. As the Y-translational adjuster 160 is extended, its overall length increases. This pushes on the first arm bushing 152 in one direction, thereby moving the first arm bushing 152 along the first arm 130 along the Y-axis accordingly. As the first arm bushing 152 translates linearly in the Y-axis, it moves the crossbar 150 in the same direction along the Y-axis. Though described here and shown in FIG. 6 as being attached to the first arm bushing 152 of the first arm 130, the Y-translational adjuster 160 may just as easily be secured by its second mounting point 163 to a second arm bushing 154 located on the second arm 140 and by its first mounting point 162 to one of the legs 100*c*, 100*d*. The second arm 140 and second arm bushing 154 are as described above for the first arm 130 and first arm bushing 152. In some embodiments, it may be desired to have two Y-translational adjusters 160, each attached to one of the first and second arm bushings 152, 154. In such embodiments, the Y-translational adjusters 160 may be operated simultaneously to coordinate the extension or contraction of the Y-translational adjusters 160 and therefore of the linear movement of the crossbar 150 along the Y-axis.

As can be appreciated from FIG. 6, the Y-translational adjuster 160 can only extend or contract as limited by its length and its total travel distance. Therefore, the movement of the arm bushing 152, 154 and crossbar 150 along the Y-axis is restricted from the area where the Y-translational adjuster 160 resides, to about 50% of the total Y dimension of the drilling area 122. This means that translational movement along the Y-axis would be limited. However, the Y-translational adjuster 160 is also selectively configurable to attach to a different leg 100, providing translational movement along the Y-axis in the opposite direction to access a different part of the drilling area 122. For instance, as depicted in FIG. 6, the first mounting point 162 of the Y-translational adjuster 160 may be released from attachment at the leg 100*b*, such as by removing a quick release pin holding the Y-translational adjuster 160 in place. The Y-translational adjuster 160 may then be swung about the second mounting point 163, where it remains attached, to now attach the first mounting point 162 to a different leg 100*a*. This position is shown in dotted lines in FIG. 6. When in this position, the arm bushing 152 and crossbar 150 may now be translated along the Y-axis in the opposite direction from its previous location. This allows the remainder of the drilling area 122 to be accessed, so the entire drilling area 122 along the Y-axis is accessible. Notably, this adjustment can be made quickly and easily in the field, as needed, without the need for tools and while still allowing full flexibility. It also keeps the weight of the overall adjustable drilling rig 10 down, which also allows for easier transportability, particularly where aerial transport to the location is required.

Turning now to FIG. 7, the crossbar 150 of the adjustable drilling rig 10 extends between the first and second arms 130, 140. Specifically, one end of the crossbar 150 is received within a portion of the first arm bushing 152 and the opposite end of the crossbar 150 is received within the second arm bushing 154. The crossbar 150 may be made of the same material and high surface finish as the first and second arms 140 discussed above. The crossbar 150 includes a crossbar bushing 156 located on the crossbar 150 between the first and second arm bushings 152, 154. At least a portion of the crossbar bushing 156 at least partially surrounds the crossbar 150, such as having a larger inner diameter than the outer circumference of the crossbar 150. This provides clearance so the crossbar bushing 156 can move along the crossbar 150, such as by sliding linear translation.

An X-translational adjuster 165 is located on the crossbar 150 to drive the linear movement of the crossbar bushing 156 along the crossbar 150 along the X-axis. As with the other adjusters, the X-translational adjuster 165 may be a hydraulic, pneumatic, electronic or manual motor, though is preferably a hydraulic motor. In at least one embodiment, it may have a travel distance that is half that of the Y-translational adjuster 160, such as up to about 12-24 inches. As with the previous adjusters, the X-translational adjuster 165 may have a power capacity of up to about 3000 psi and an operative capacity of about 500-1000 psi, though other ranges are also possible. As shown in FIG. 7, the X-translational adjuster 165 includes a first mounting point 168 at one end and a second mounting point 169 at the opposite end. Preferably, the first and second mounting points 168, 169 are located at terminal ends of the X-translational adjuster 165, such as on the piston and cylinder thereof in a hydraulic. The first mounting point 168 is secured to an arm bushing, such as the first arm bushing 152 as shown in FIG. 7. The second mounting point 168 is secured to the crossbar bushing 156. When the X-translational adjuster 165 is activated, it extends or contracts, moving the crossbar bushing 156 along the crossbar 150 in a linear translational motion along the X-axis. As with the Y-translational adjuster 160, the translational movement provided by the X-translational adjuster 165 is also limited by its length. When in place, the X-translational adjuster 165 permits linear translation along the X-axis for a portion of the drilling area 122, such as about 50% thereof. However, it is also selectively configurable to access the other part of the drilling area 122. To accomplish this, the first mounting point 168 of the X-translational adjuster 165 is released from the arm bushing, such as the first arm bushing 152 by removing a quick release pin as described previously. The second mounting point 169 of the X-translational adjuster 165 is released from the crossbar bushing 156, which may also occur by removing a quick release pin. The X-translational adjuster 165 is then positioned along the other side of the crossbar 150 in the opposite orientation, and the first mounting point 168 is secured to the other arm bushing, such as the second arm bushing 154, and the second mounting point 169 is secured to the crossbar bushing 156 at a different bracket or connection point. Accordingly, the crossbar bushing 156 may have a plurality of connection brackets for adjusters. This new position of the X-translational adjuster 165 is shown in the dotted lines in FIG. 7. In this position, the crossbar bushing 156 can be linearly translated along the X-axis on the other side of the crossbar 150, allowing the other half of the drilling area 122 to be accessed. This also aids in the full flexibility of the adjustable drill rig 10 without requiring tools to adjust and minimizing weight for transportability.

Figure 8:
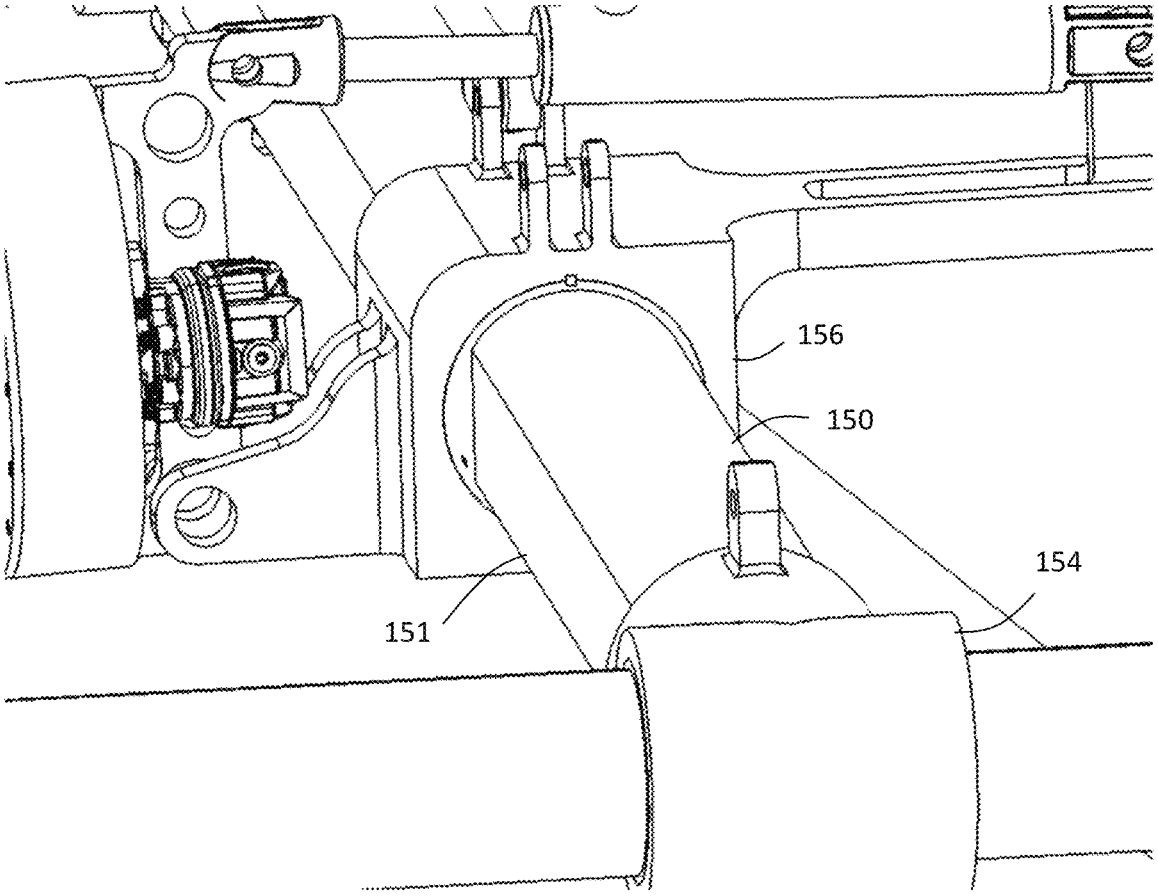
FIG. 8 is a detail view of one end of the crossbar.

The crossbar 150 may preferably have non-cylindrical cross-section. For instance, in at least one embodiment as shown in FIG. 8, the crossbar 150 may have at least one flat edge 151 that provides a keyed configuration. The opening in the crossbar bushing 156 through which the crossbar 150 passes is preferably similarly keyed with a corresponding flat edge to match the flat edge 151 of the crossbar 150. This keyed or mated flat edge 151 prevents the crossbar bushing 156 from rotating about the crossbar 150 as it translates linearly there along. In other embodiments, the crossbar 150 may have a cylindrical cross-section. In such embodiments, the crossbar 150 may be secured within the arm bushings 152, 154, such as with screws, clamps, adhesives, welding or other similar securing mechanisms, or may be frictionally fit within the arm bushings 152, 154 to provide a snug fit and prevent slipping or rotation of the crossbar 150 within the arm bushings 152, 154. The crossbar bushing 156 may therefore have a tighter clearance with the crossbar 150 to prevent rotation during linear translation.

Figure 9:
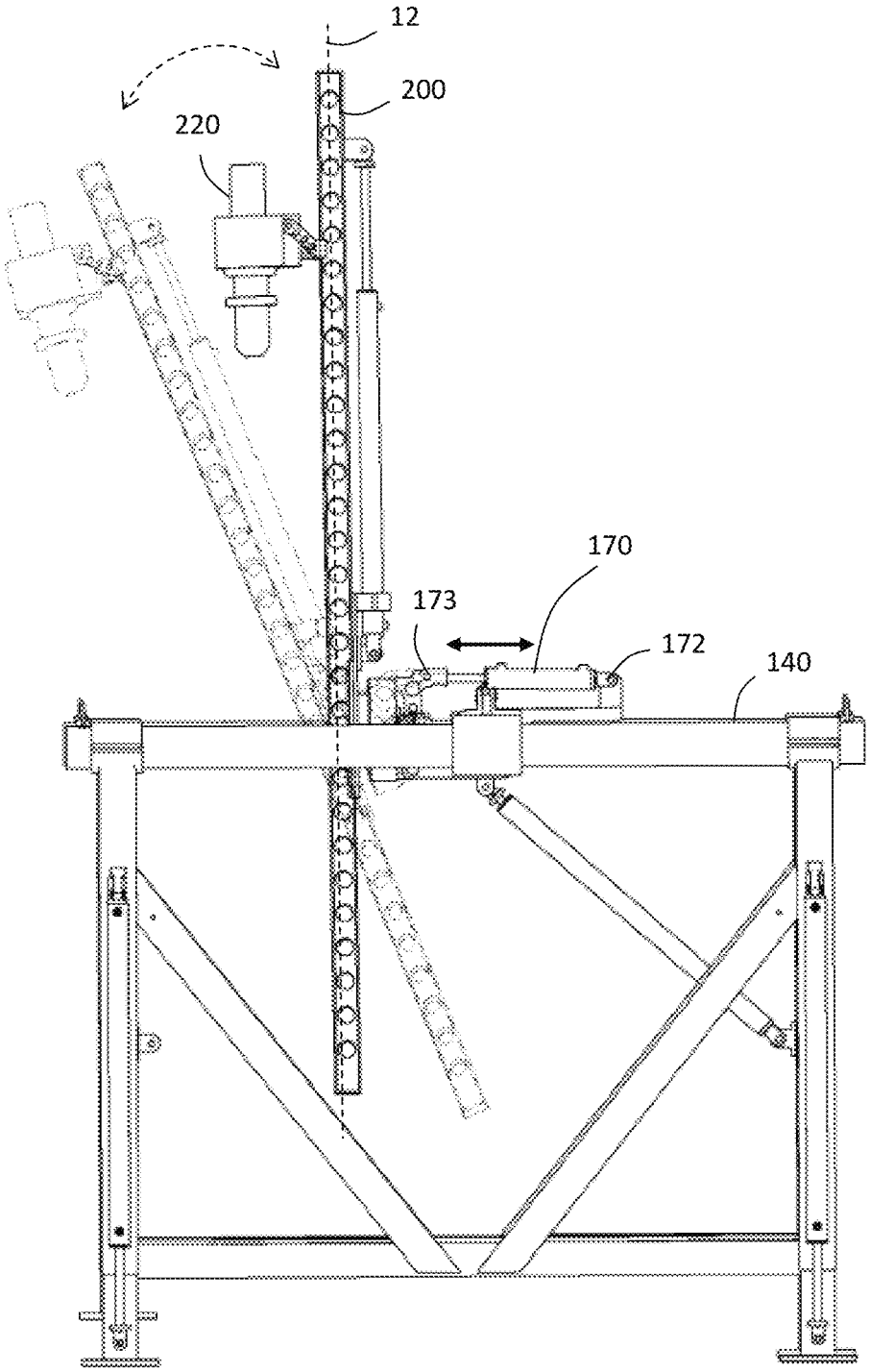
FIG. 9 is a side elevation view of showing the X-rotational adjuster for rotational movement about the X-axis.
Figure 10:
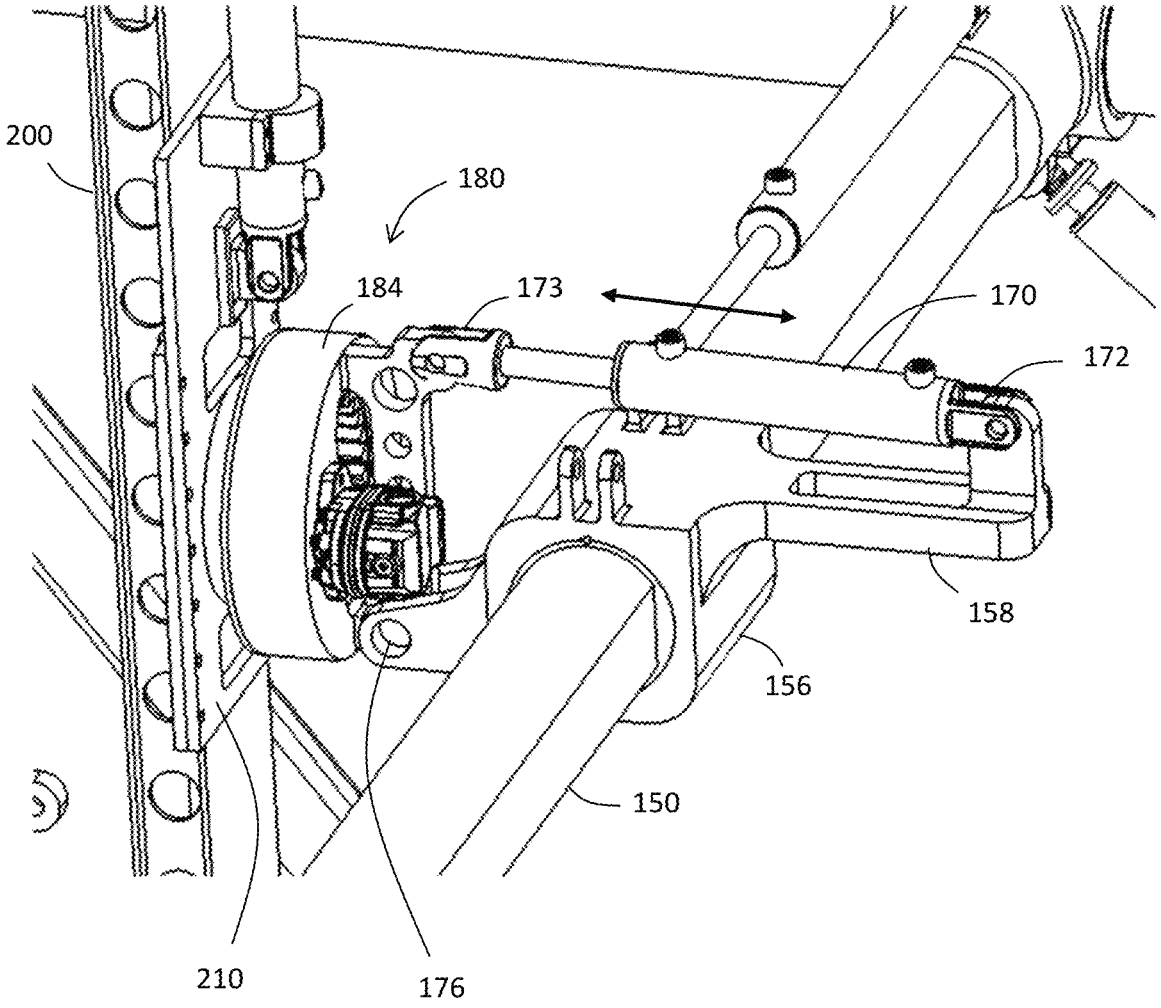
FIG. 10 is a detail view of the X-rotational adjuster of FIG. 9 and the Y-rotational adjuster.

The adjustable drill rig 10 also includes an X-rotational adjuster 170, such as shown in FIGS. 9 and 10, that rotates the mast 200 and drill head 220 about the X-axis. In at least one embodiment the X-rotational adjuster 170 may provide rotation forward or rearward about the X-axis relative to the reference axis 12, such as but not limited to up to 30° though other angles are also possible. In the embodiment shown in FIGS. 9 and 10, being a linear adjuster, the length of the X-rotational adjuster 170 dictates the amount of rotation possible about the X-axis. For instance, in at least one embodiment the X-rotational adjuster 170 may have a linear travel distance of up to about 8-10 inches, providing rotation about the X-axis of up to 30° to either side of the reference axis 12. The X-rotational adjuster 170 may be a rotational or linear adjuster, though in the embodiment in FIGS. 9 and 10 the X-rotational adjuster 170 is a linear adjuster. In other embodiments in which it is a rotational adjuster, it may be as described below for the Y-rotational adjuster 180 and may be capable of rotation around a full 360°, preferably providing operative rotation of up to 60° from the reference axis 12 in some embodiments, and up to about 30° from the reference axis 12 in other embodiments. The X-rotational adjuster 170 may be a hydraulic, pneumatic, electric or manual motor as the other adjusters discussed above. In at least one embodiment, it is a linear hydraulic motor having a cylinder and piston, such as with a travel distance of up to about 8-10 inches and a power capacity of up to about 3000 psi. In at least one embodiment, the X-rotational adjuster 170 may operate in the range of about 2000-2500 psi since it must support the weight of the mast 200 and drill when rotated at an angle, thus requiring more power than the adjusters discussed previously. Other operative pressures are also contemplated and possible.

As shown in FIGS. 9 and 10, the X-rotational adjuster 170 includes a first mounting point 172 at one end and a second mounting point 173 at an opposite end. In some embodiments, the first and second mounting points 172, 173 may be brackets enabling quick release, such as discussed above in connection with the previous adjusters. In other embodiments, the first and second mounting points 172, 173 may be fixedly secured to their corresponding attachment structures. The first mounting point 172 secures to the crossbar bushing 156. In some embodiments, as shown in FIG. 10, the crossbar bushing 156 may have an extension 158 projecting laterally from the crossbar 150. This extension 158 is long enough to accommodate the length of the X-rotational adjuster 170, as one end of the X-rotational adjuster 170 is mounted thereto. In at least one embodiment, as shown in FIG. 10, the first mounting point 172 is located at a terminal end of the X-rotational adjuster 170 and connects to a bracket at a terminal end of the extension 158 of the crossbar bushing 156. The second mounting point 173 at the opposite end of the X-rotational adjuster 170 interconnects to the mast 200, such as through the mounting plate 210. In at least one embodiment, as seen in FIG. 10, the second mounting point 173 of the X-rotational adjuster 170 connects to a bracket on the drum 184 of a Y-rotational adjuster 180, described below, which itself is mounted to the mounting plate 210. In other embodiments, the second mounting point 173 of the X-rotational adjuster 170 may connect directly to the mounting plate 210 on the mast 200, or to the mast 200 itself.

When the X-rotational adjuster 170 is activated, it extends or contracts according to the direction provided during activation. As it extends or contracts, it causes the mast 200 to pivot about pivot point 176, as shown in FIGS. 9 and 10. The pivot point 176 is the connection point between the mast 200 and the crossbar bushing 156. For instance, in the embodiment shown in FIG. 10, the pivot point 176 is the point at which the drum 184 of a Y-rotational adjuster 180 attaches to the crossbar bushing 156. The mast 200 in turn connects to the other side of this drum. In other embodiments, the pivot point 176 may be at a point connecting the crossbar bushing 156 directly to the mounting plate 210 or directly to the mast 200, depending on where the connection to the crossbar bushing 156 is made.

Figure 11:
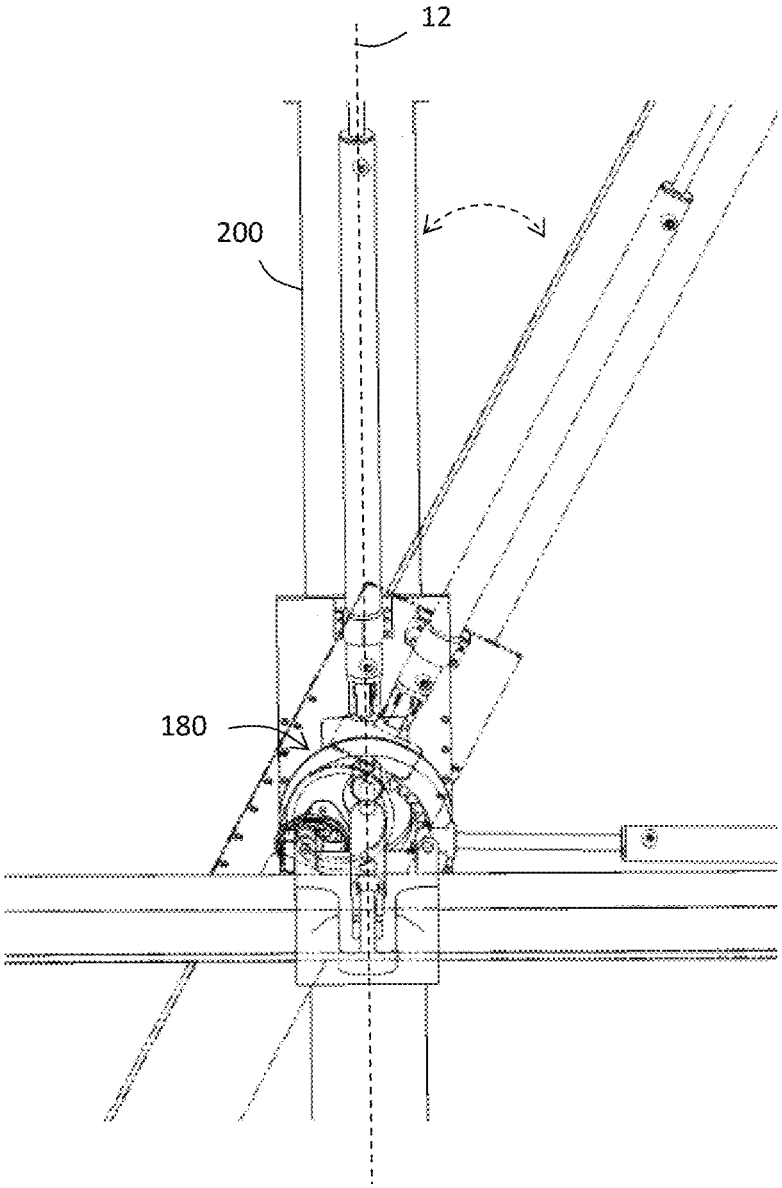
FIG. 11 is a rear partial view showing the Y-rotational adjuster for rotational movement about the Y-axis.
Figure 12:
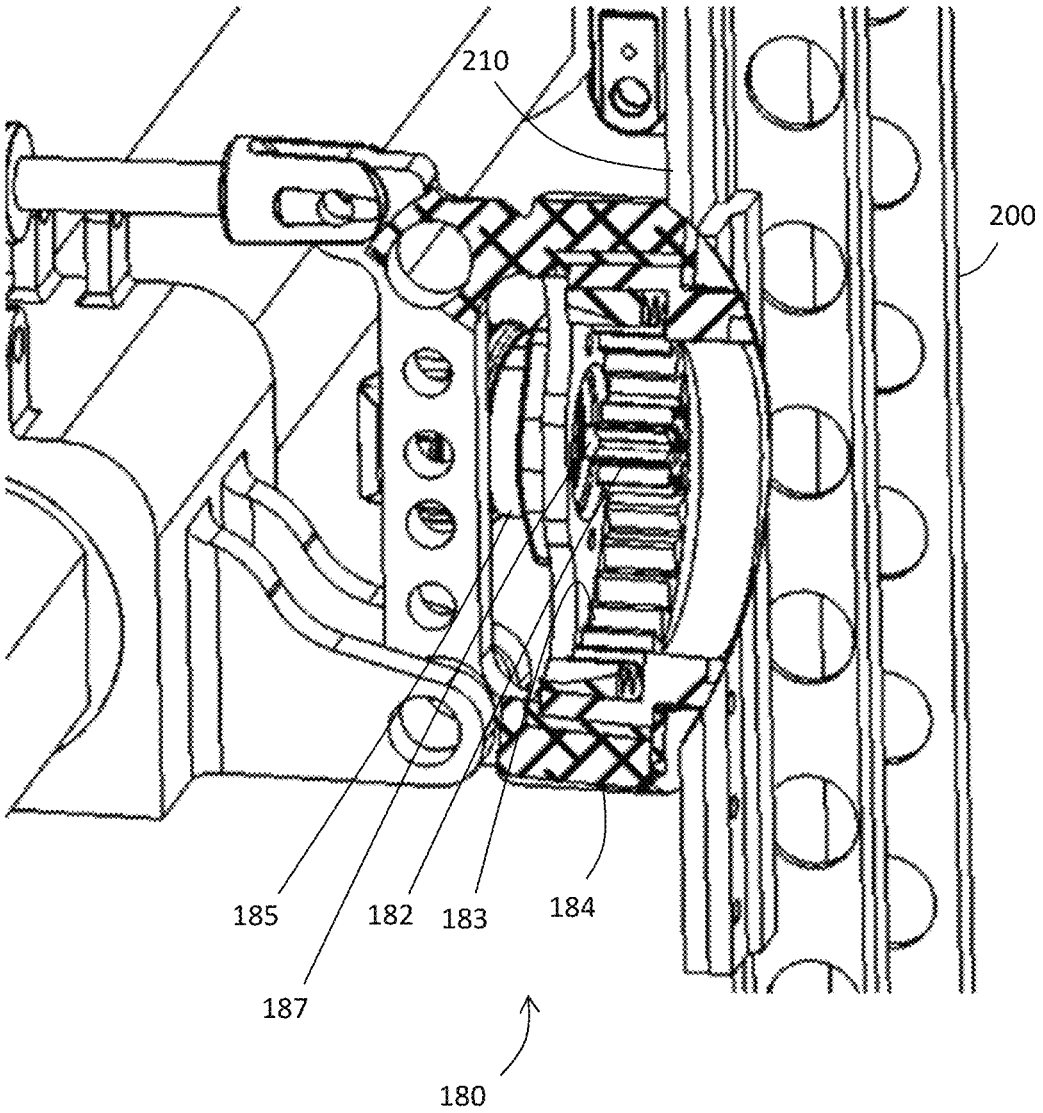
FIG. 12 is a detail partial cutaway of the Y-rotational adjuster of FIG. 11.

The adjustable drilling rig 10 also includes a Y-rotational adjuster 180, shown in FIGS. 11 and 12, capable of rotating the mast 200 and drill head 220 about the Y-axis by a full 360°. In at least one embodiment as depicted in FIG. 11, the Y-rotational adjuster 180 provides rotation about the Y-axis of up to about 60° to either side of the reference axis 12, and preferably up to about 30° to either side of the reference axis 12, though other angles are also contemplated depending on the requirements of the drill site and the adjustable drill rig 10. Preferably, the Y-rotational adjuster 180 and X-rotational adjuster 170 may operatively provide the same amount or degree of maximum rotation of the mast 200 relative to the reference axis 12 to achieve a radial cone 300 for drilling, as shown in FIG. 4A, even if the same angle is not used for each in practice. The Y-rotational adjuster 180 may be a rotational or linear adjuster, though in the embodiment in FIGS. 11 and 12 the Y-rotational adjuster 180 is a rotational motor. For instance, the Y-rotational adjuster 180 may be a ring and pinion type rotational motor and may be hydraulically, pneumatically, electrically or manually driven. Preferably, it is hydraulically driven as are the other adjusters. In at least one embodiment, the Y-rotational adjuster 180 may have a shaft in the range of about 0.5-2 inches, preferably about 1.75 inches, with inlet pressure of up to 2500 psi (for driving capabilities) and a back pressure of up to 1000 psi (for holding capabilities), though other pressures are also contemplated. Examples include but are not limited to the heavy-duty hydraulic motor made by Prince, although similar hydraulic motors by other manufacturers such as McMaster and others are also possible. In other embodiments, the Y-rotational adjuster 180 may be a rotational hydraulic motor, such as but not limited to a gear motor or vane motor.

As shown in FIG. 12, the Y-rotational adjuster 180 includes a pinion 183 of gear teeth movably retained within a drum 184 that is connected to the mast 200. A ring gear 182 connects to the shaft from a motor 185 of the Y-rotational adjuster 180 at one end, and the teeth of the ring gear 182 interdigitate with the gear teeth of the pinion 183 at the opposite end. The sizes of the ring 182 and pinion 183 will depend on the size and weight of the mast 200, the rotational requirements for it, and the rig 10 overall. In at least one embodiment, the ring 182 may have an outer diameter of about 3-4 inches and the pinion 183 may have an outer diameter of about 12-14 inches. When the motor 185, such as a hydraulic or electric motor, is activated, it rotates a shaft 187, which extends into the ring 182 and causes the ring 182 therewith to rotate. As the toothed outer terminal end of the ring 182 rotates, it engages the gear teeth on the inner surface of the pinion 183 and pulls or pushes the pinion 183 circumferentially about within the drum 184, either in a clockwise or counterclockwise direction depending on the rotation of the motor 185 and ring 182. At least one linkage extends between and securely connects the drum 184 of the Y-rotational adjuster 180 to the mounting plate 210 (as shown in FIGS. 11 and 12) or to the mast 200 directly. The linkage(s) may be made of the same material as the ring 182, pinion 183 or other component of the Y-rotational adjuster 180, such as but not limited to steel, stainless steel and aluminum. In some embodiments, the linkage(s) may be screws, bolts, or other elongate connecting hardware. In other embodiments, the linkage(s) may be rods or even points where the drum 184 and the mounting plate 210 or mast 200 are permanently affixed, such as but not limited to through welding. Thus, as the pinion 183 rotates about the Y-axis within the drum 184, driven by the motor 185, so does the mounting plate 210 and mast 200 similarly rotate about the Y-axis.

The mast 200 of the adjustable drill rig 10 is an elongate structure to which the drill head 220 is attached. The drill will, in turn, mount to the drill head 220 so positioning of the drill head 220 as described herein by the various adjusters results in positioning of the drill once mounted. The mast 200 therefore must support the weight of the drill. The mast 200 may be made of steel, stainless steel, aluminum, or other high strength but lightweight metals, metal alloys or other material. The mast 200 has an elongate length that extends in the direction of the Z-axis. In at least one embodiment, it may have a length of up to 8-10 feet, though other lengths are also contemplated and may depend on the specification or requirements of the drill site, desired micropile array configuration and/or depth, and weight of the drill to be attached, among other considerations. The mast 200 may include at least one track 202 along at least a portion of its length. In the embodiments shown in FIGS. 13 and 14, the mast 200 includes two tracks 202, one on each lateral side of the mast 200. Each track 202 may include a series of apertures 204 and grooves 206 which may be used to mount the drill head 220 to the mast 200.

Figure 13:
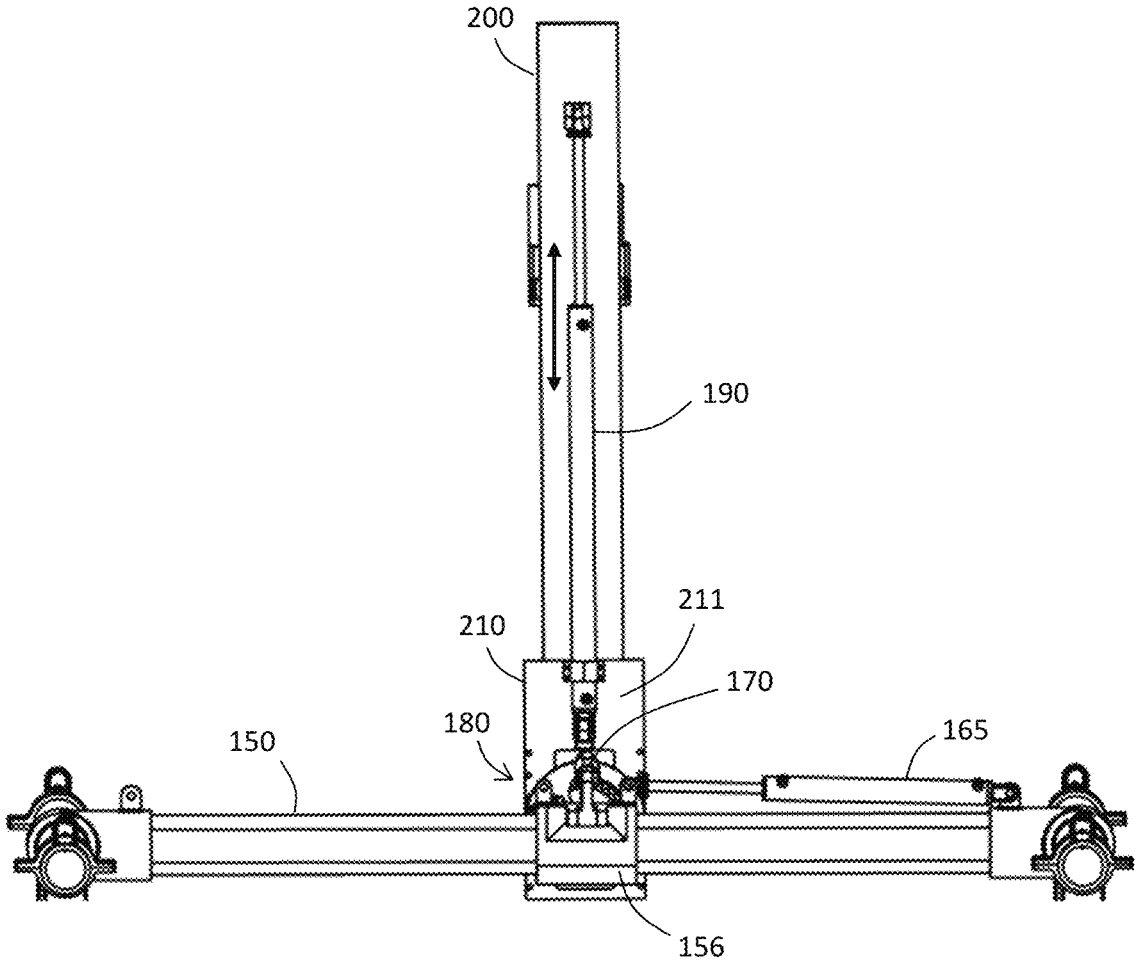
FIG. 13 is a rear partial view of the mast, mounting plate and Z-translational adjuster.
Figure 14:
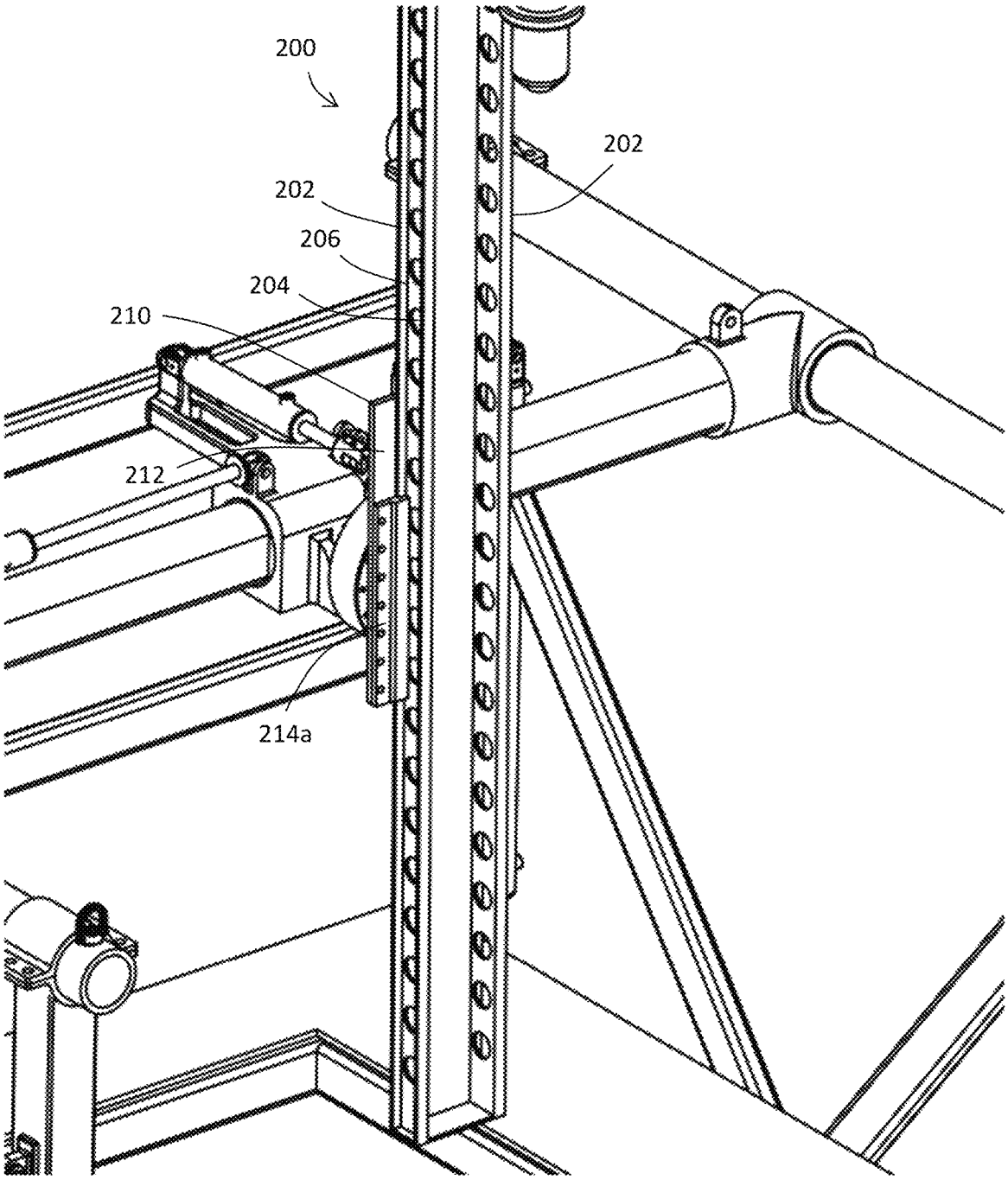
FIG. 14 is a front partial view of the mast and mounting plate.

The mast 200 connects to the rest of the assembly through the crossbar bushing 156 so that it moves linearly along the X-axis relative to the crossbar 150 with the movement of the X-translational adjuster 165, rotationally about the X-axis with the movement of the X-rotational adjuster 170, and rotationally about the Y-axis with the movement of the Y-rotational adjuster 180. In at least one embodiment the adjustable drill rig 10 includes a mounting plate 210 that is slidably affixed to the mast 200, as shown in FIGS. 13 and 14. The mast 200 may connect to the crossbar bushing 156 through connection to the mounting plate 210. For instance, as explained above, the crossbar bushing 156 may pivotally connect to the Y-rotational adjuster 180 at pivot point 176, and the Y-rotational adjuster 180 may in turn connect to the mounting plate 210 at the ring 182 thereof. In some embodiments, the crossbar bushing 156 may connect directly to the mounting plate 210.

The mounting plate 210 may have any shape and preferably has a planar body defined between a first surface 21, shown in FIG. 13, and an opposite second surface 212, shown in FIG. 14. The first surface 211 is positioned nearest to, and facing, the crossbar bushing 156 and is the surface to which the Y-rotational adjuster 180 mounts. The first surface 211 may be accessible from the rear of the adjustable drill rig 10. Here, the term "rear" may refer to the side of the rig 10 opposite from the drill head 220, which may be referred to as the "front" of the rig 10. The first surface 211 of the mounting plate 210 is preferably planar and receives the Y-rotational adjuster 180 (such as a portion connecting to the ring 182) thereon. It may also receive the second mounting point 173 of the X-rotational adjuster 170 in some embodiments (not shown). The second surface 212 is opposite the first surface 211 and faces and/or slidingly abuts the mast 200.

The mounting plate 210 also includes at least one, though preferably a plurality of lips 214*a*, 214*b* that extend from the planar body of the mounting plate 210 in the direction away from the crossbar bushing 156 and toward the front of the rig 10. In at least one embodiment, the mounting plate 210 includes two lips 214*a*, 214*b*, each one extending from a different peripheral edge of the mounting plate 210, preferably the lateral sides of the mounting plate as in FIG. 14. Though only lip 214*a* is shown in FIG. 14, it should be appreciated that a similar lip 214*b* exists on the other lateral side of the mounting plate 210 and engages the other side of the mast 200. The lips 214*a*, 214*b* extending along at least a portion of the depth of the mast 200 sufficient to wrap around at least a portion of the mast 200 to slidably attach the mounting plate 210 thereto. For instance, as shown in FIG. 14, each of the lips 214*a*, 214*b* extend far enough to wrap around and engage a groove 206 at the rear of the mast 200, such as may be defined by a track 202 on the mast 200. Each side of the mast may have a track 202, or the track 202 may extend through the mast 200. The lips 214*a*, 214*b* of the mounting plate 210 are therefore at least as long as the depth of the rear surface, groove 206 or track 202 of the mast 200. In some embodiments, the lips 214*a*, 214*b* may be substantially the same length as the depth of the mast 200.

In a preferred embodiment, the terminal ends of the lips 214*a*, 214*b* extend past and hook around and/or loop back onto the groove 206 formed by the track 202 in the mast 200 or the mast 200 itself, as shown in FIG. 14. At least a portion of the mast 200 is therefore held between the terminal ends of the lips 214*a*, 214*b* of the mounting plate 210 and the second surface 212 of the mounting plate 210 that abuts the mast 200. However, there is still sufficient clearance between the terminal ends of the lips 214*a*, 214*b* and the mast 200 that either the mounting plate 210 and/or mast 200 may be slidably moved relative to the other in adjusting along the Z-axis.

Figure 15:
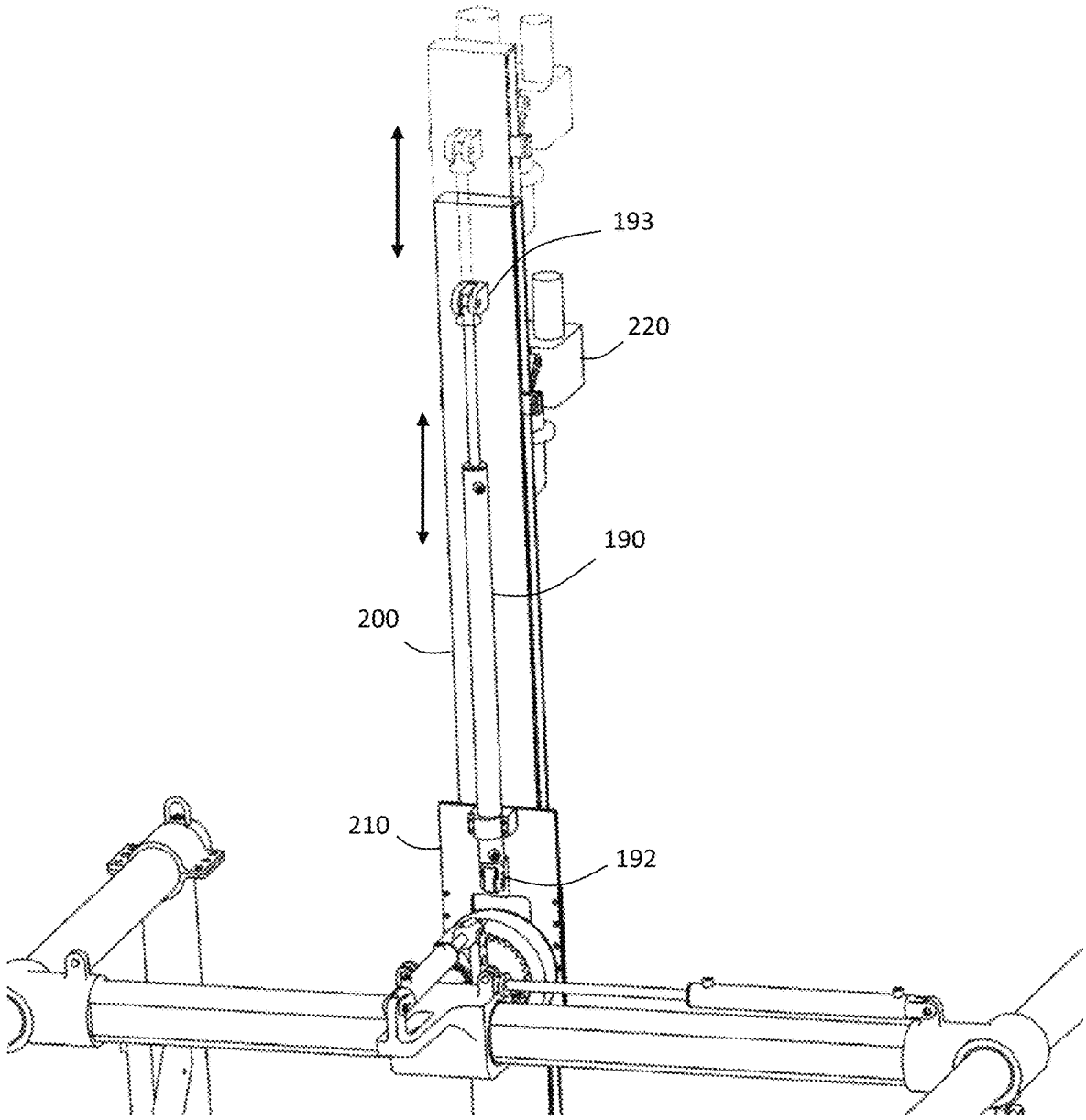
FIG. 15 is a rear partial view of the Z-translational adjuster for movement along the Z-axis.

The adjustable drill rig 10 also includes a Z-translational adjuster 190, as shown in FIGS. 13 and 15, which moves the mast 200, and consequently the drill head 220, linearly along the Z-axis. Thus, the Z-translational adjuster 190 allows the mast 200 carrying the drill head 220 to translate vertically, enabling the adjustment of tooling height. As with the other adjusters, the Z-translational adjuster 190 may be a hydraulic, pneumatic, electronic or manual motor, though is preferably a hydraulic motor as shown in FIG. 13 and similar to other hydraulic motor adjusters discussed above. For instance, it may have a cylinder and piston with the cylinder having a diameter in the range of about 3-4 inches, a power capacity of up to about 3000 psi and operative in a range of about 2000-2500 psi for load-bearing purposes, in at least one example, though other parameters are also possible. The Z-translational adjuster 190 includes a first mounting point 192 connected to the mounting plate 210, as shown in FIG. 13, and an opposite second mounting point 193 connected to the mast 200, as shown in FIG. 15. Preferably, the first and second mounting points 192, 193 are located at terminal ends of the Z-translational adjuster 190, such as on the piston and cylinder thereof in a hydraulic. When the Z-translational adjuster 190 is activated, it extends or contracts, moving the mast 200 linearly along the Z-axis. As with the previous translational adjusters, the translational movement provided by the Z-translational adjuster 190 is also limited by its length and travel distance, thus controlling how far up or down the mast 200 may be extended. For instance, the Z-translational adjuster 190 has an overall length less than the length of the mast 200. In at least one embodiment, the Z-translational adjuster 190 has a travel distance of up to 50% of the total mast length, preferably in the range of about 25%-50% of the total mast length, though in some embodiments it may have a travel distance of at least 35% of the total mast length, and still more preferably about 50% of the total mast length. In one example in which the mast 200 has a length of 8-10 feet, the Z-translational adjuster 190 may provide a travel distance of up to 4-5 feet. This is but one non-limiting example for illustrative purposes. As the Z-translational adjuster 190 extends or contracts, it moves the mast 200, which slides relative to the mounting plate 210. Specifically, the lips 214*a*, 214*b* of the mounting plate 210 slidable hold the mast 200, such as by the grooves 206 formed therein, and permits the mast 200 to slidably move relative to the lips 214*a*, 214*b*.

Figure 16:
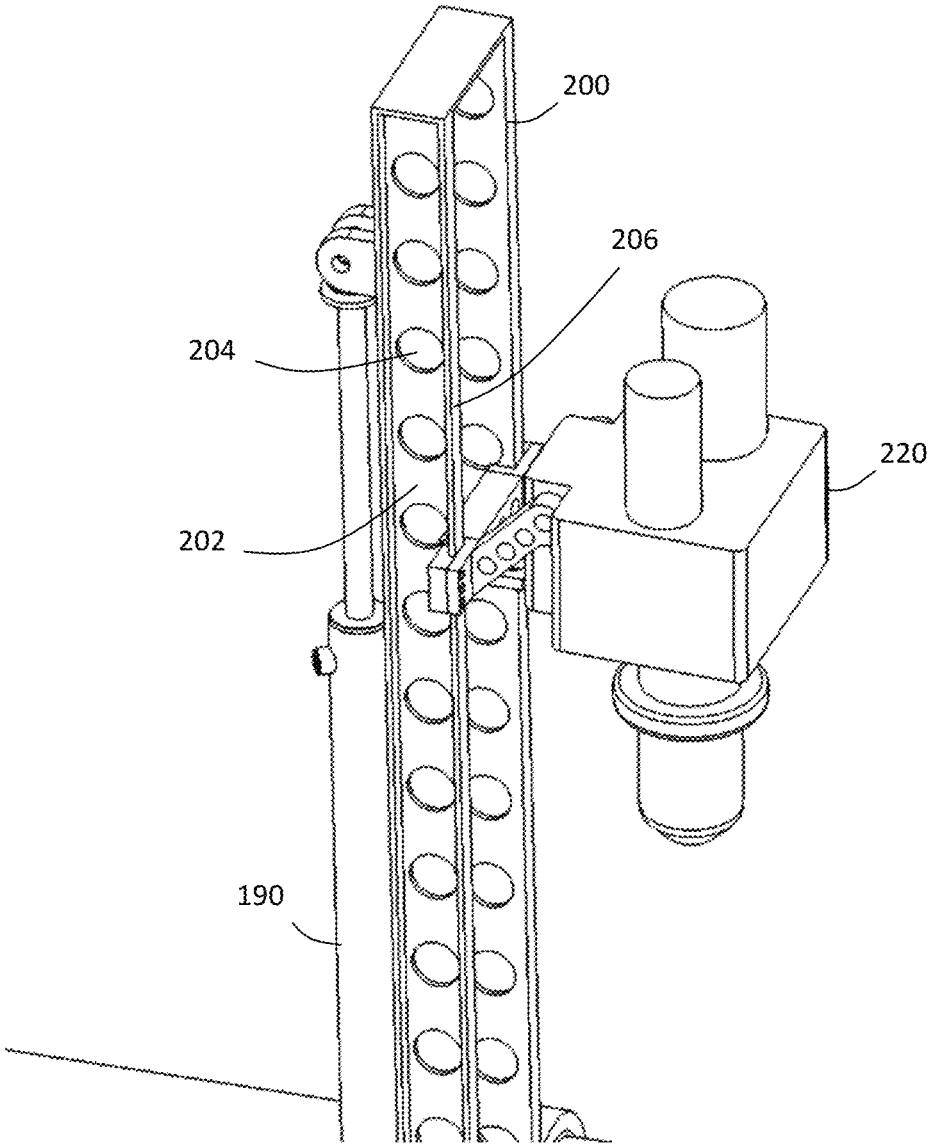
FIG. 16 is a detail view of one embodiment of the drill head and mast.

Turning to FIG. 16, a drill head 220 is mounted to the mast 200 on the front side of the rig 10 and opposite from the various adjusters discussed previously. The drill head 220 is configured to receive the tooling to be used at the drill site, such as the drill. By having the drill head 220 secured to and movable with the mast 200, adjustments to the tooling height, position and angle can be made easily and more readily viewable for confirmation of position and approach before the tooling is added to the rig 10. The drill head 220 may mount directly to the front side of the mast 200 or by the track(s) 202 which may be along the front or sides of the mast 200. For instance, as shown in FIG. 16, the drill head 220 mounts to front grooves 206 along the tracks 202 of the mast 200, such as with a bracket that clamps to the groove 206 of the track 202, as in FIG. 16, or may be secured to an aperture 204 in the track 202 by screws or bolts. The drill head 220 mounting may be secure and fixed, so that the drill head 220 is fixed and stationary relative to the mast 200. In some embodiments, however, such as FIG. 17, the drill head 220 may be rotatably mounted to the mast 200, such as about a drill head pivot point 223. A pin may be removed from the drill head pivot point 223 to enable rotation about the drill head pivot point 223 for adjustment, then when the desired position is achieved the pin may be reinserted to lock in the position.

Figure 17:
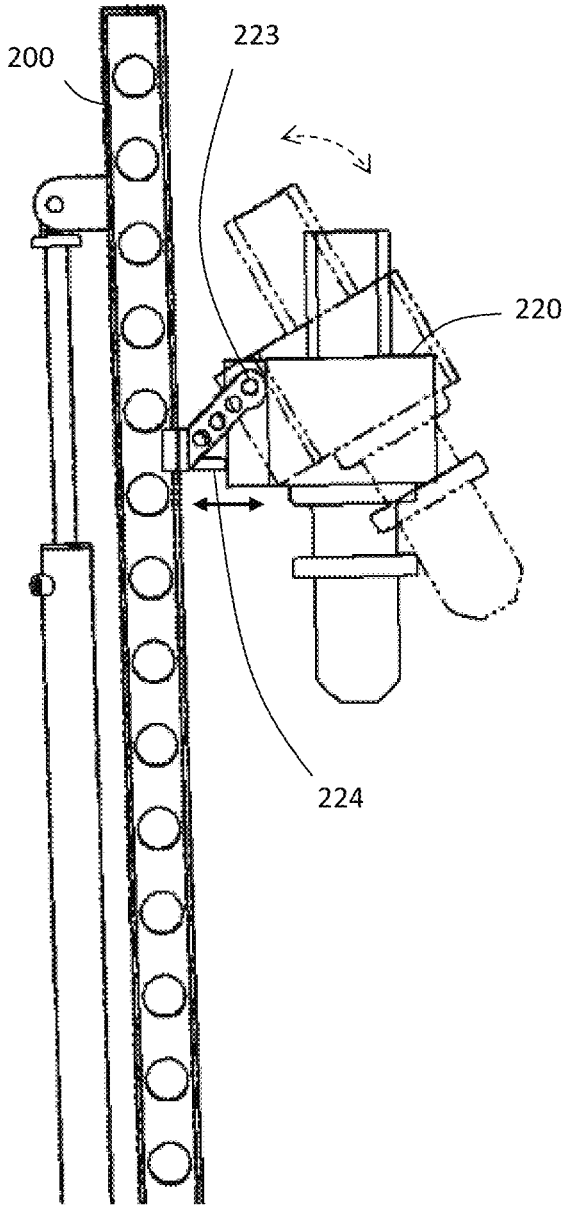
FIG. 17 is a side detail view of the drill head of FIG. 16 showing a drill head adjuster for adjusting the angle of the drill head relative to the mast.

In some embodiments, as in FIG. 17, there may be a drill head adjuster 224 which may be used to rotate the drill head about the drill head pivot point 223. Such drill head adjuster 224 may be a linear motor, such as a hydraulic, pneumatic or electric motor as described previously, and particularly similar to the X-rotational adjuster 165 discussed above. Such a drill head adjuster 224 may include a first mounting point 226 secured to the mast 200 and an opposite second mounting point 228 secured to the drill head. When activated, the drill head adjuster 224 may extend linearly, causing the drill head 220 to rotate about the drill head pivot point 223 and the X-axis. This is in addition to the X-rotational adjuster 165. In other embodiments, the drill head adjuster 224 may be a rotational motor similar but not limited to the Y-rotational adjuster 170 discussed previously.

Since many modifications, variations and changes in detail can be made to the described preferred embodiments, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. An adjustable drilling rig, comprising:

a support frame defining a perimeter of said adjustable drilling rig, said support frame comprising a plurality of legs each selectively adjustable in one of a first and second plane each defined between different ones of said legs, said plurality of legs collectively defining a drilling area therebetween such that said drilling area is within said perimeter of said adjustable drilling rig;

a translational frame selectively mounted to said support frame, at least a portion of said translational frame selectively independently moveable along:

i) an X-axis direction in a third plane perpendicular to said first and second planes, and;

(ii) a Y-axis direction in said third plane;

a mast slidably mounted to said translational frame and selectively independently movable:

(iii) translationally along said translational frame along said X-axis direction in a fourth plane extending perpendicular to said first and second planes along a length of said mast and transverse to said third plane;

(iv) rotationally within said fourth plane; and (v) rotationally within a fifth plane extending said length of said mast, parallel to and between said first and second planes, and intersecting said third and fourth planes;

a drill head secured to said mast and receiving a drill tool thereon; and said portion of said translational frame and said mast collectively movable to position said drill head at any location within said perimeter of said support frame to enable drilling at any angle within said drilling area.

2. The adjustable drilling rig as recited in claim 1, further comprising a plurality of adjusters each selectively and independently actuated to move at least one of said portion of said translational frame and said mast in one of five degrees of freedom.

3. The adjustable drilling rig as recited in claim 2, wherein each of said adjusters is one of: (i) a linear actuator, (ii) a rotational actuator; and wherein each of said adjusters is further one of: (iii) hydraulic, (iv) pneumatic, (v) electric, and (vi) manual.

4. The adjustable drilling rig as recited in claim 2, wherein said support frame further comprises a platform secured between said legs, said drilling area extending through said platform.

5. The adjustable drilling rig as recited in claim 1, wherein each of said plurality of legs includes a leg adjuster selectively and independently actuated to move said leg along a Z-axis and one of said first and second planes.

6. The adjustable drilling rig as recited in claim 1, wherein said translational frame includes a first arm, a second arm spaced apart from said first arm, and a crossbar extending between and selectively movable along said first and second arms, said mast mounted to said crossbar.

7. The adjustable drilling rig as recited in claim 6, wherein said first arm, said second arm, and said crossbar are all co-planar along said third plane.

8. The adjustable drilling rig as recited in claim 6, wherein said first and second arms are selectively connected to said plurality of legs to mount said translational frame to said support frame.

9. The adjustable drilling rig as recited in claim 6, further comprising a Y-translational adjuster removably secured to one of said legs and to said crossbar, said Y-translational adjuster selectively activated to move said mast in said Y-axis direction along said third plane.

10. The adjustable drilling rig as recited in claim 9, wherein said Y-translational adjuster is selectively detachable from said one of said legs and attachable to a different one of said legs to permit movement of said mast along said Y-axis direction in said third plane in an opposite direction.

11. The adjustable drilling rig as recited in claim 6, further comprising an X-translational adjuster removably connected to said translational frame and to said mast, said X-translational adjuster selectively activated to move said mast in said X-axis direction along said fourth plane.

12. The adjustable drilling rig as recited in claim 11, wherein said X-translational adjuster is selectively detachable from said translational frame and attachable to a different position along said translational frame to permit movement of said mast along said X-axis direction in said fourth plane in an opposite direction.

13. The adjustable drilling rig as recited in claim 6, further comprising a crossbar bushing slidably affixed to and moveable along said crossbar between said first and second arms, said mast connected to said crossbar bushing.

14. The adjustable drilling rig as recited in claim 13, wherein said crossbar has a keyed configuration and said crossbar bushing has a correspondingly keyed configuration mated to said keyed configuration of said crossbar.

15. The adjustable drilling rig as recited in claim 6, further comprising an X-rotational adjuster connected to said translational frame and to said mast, said X-rotational adjuster selectively activated to move said mast rotationally within said fifth plane.

16. The adjustable drilling rig as recited in claim 6, further comprising a Y-rotational adjuster connected to said translational frame and to said mast, said Y-rotational adjuster selectively activated to move said mast rotationally within said fourth plane.

17. The adjustable drilling rig as recited in claim 1, wherein said mast is selectively independently movable translationally along a Z-axis direction in said fourth plane.

18. The adjustable drilling rig as recited in claim 17, further comprising a Z-translational adjuster affixed to said mast, said Z-translational adjuster selectively activated to move said mast linearly along said Z-axis relative to said translational frame.

19. The adjustable drilling rig as recited in claim 18, further comprising a mounting plate, said mast slidably affixed to said mounting plate, said Z-translational adjuster connected to said mounting plate.

20. The adjustable drilling rig as recited in claim 1, further comprising a drill head adjuster connected to said drill head and said mast, said drill head adjuster selectively activated to rotate said drill head.

21. The adjustable drilling rig as recited in claim 1, wherein said support frame and said translational frame are separately transportable to a drill site.

22. The adjustable drilling rig as recited in claim 1, wherein said translational frame is selectively mountable to said legs of said support frame.

23. The adjustable drilling rig as recited in claim 1, wherein said support frame is stationary.

* * * * *